US006132088A

United States Patent [19]

Suzuki

[11] Patent Number: 6,132,088

[45] Date of Patent: Oct. 17, 2000

[54] MOUNTING SYSTEM FOR A CARGO SPACE INNER LINER BAG

[75] Inventor: Michiharu Suzuki, Tokyo, Japan

[73] Assignees: Ogawa Tent Co., Ltd.; Kawasaki Kisen Kaisha, Ltd., both of Tokyo, Japan

[21] Appl. No.: 09/109,919

[22] Filed: Jul. 2, 1998

[30] Foreign Application Priority Data

Jul. 3, 1997 [JP] Japan ..... 9-178728

[51] Int. Cl.[7] ..... B65D 33/14

[52] U.S. Cl. ..... 383/23; 383/97; 220/482; 220/495.08

[58] Field of Search ..... 383/13, 22, 23, 383/97; 220/482, 495.08, 62.21, 23.91, 9.1

[56] References Cited

U.S. PATENT DOCUMENTS

| | | | |
|---|---|---|---|
| 1,862,384 | 6/1932 | Millar | 383/23 |
| 2,159,279 | 5/1939 | Lipowsky et al. | 383/22 |
| 2,437,099 | 3/1948 | Krupp | 383/97 X |
| 3,000,419 | 9/1961 | Morrison | 383/97 X |
| 4,273,223 | 6/1981 | Tomlinson | 383/97 X |
| 4,674,127 | 6/1987 | Yamada et al. | 383/22 X |
| 4,724,791 | 2/1988 | McSorley | 383/97 X |
| 4,792,239 | 12/1988 | Hamada et al. . | |
| 4,801,042 | 1/1989 | Hamada et al. . | |
| 4,911,317 | 3/1990 | Schloesser et al. | 220/495.08 X |
| 5,011,008 | 4/1991 | Baker | 383/97 X |

FOREIGN PATENT DOCUMENTS

| | | | |
|---|---|---|---|
| 1165244 | 10/1958 | France | 383/13 |
| 5-62490 | 8/1993 | Japan . | |

*Primary Examiner*—Jes F. Pascua
*Attorney, Agent, or Firm*—Pollock, Vande Sande & Amernick

[57] ABSTRACT

There are provided a mounting device, an inner bag for a cargo accommodating space and a water damage preventing curtain for a cargo accommodating space provided with such a device whereby a mounted article can be mounted in a desired condition by making the position of the mounted article movable. An inner bag 10 has a bag body 12 and a connecting element 14 whereby bag body 12 is connected to a container 50. Connecting element 14 is provided along the junction line between left face 20 and top face 16 of bag body and along the junction line between right face 22 and top face. Mounting devices 38 having a sliding fastener 34 and mounting member 36 are provided on this connecting element 14. Sliding fastener has a pull and a slider that is capable of being slid along a track. A mounting member is connected to this slider. Mounting member 36 is capable of being connected to container mounting members 64 provided at the top part of left and right walls 56, 58 of container. Also, since mounting member is connected to the slider, mounting member can be moved along sliding fastener.

18 Claims, 17 Drawing Sheets

MOUNTING SYSTEM FOR A CARGO SPACE INNER LINER BAG

BACKGROUND OF THE INVENTION

1. Field of the Invention

The present invention relates to mounting devices etc., in particular, to a mounting device with a movable mounting member, an inner bag for a cargo accommodating space provided with such a mounting device, and a curtain for preventing water damage in a cargo space.

2. Description of the Related Art

A method of mounting an article to be mounted (mounted article) in a place where mounting is to be effected (mounting location) consists in providing a mounted article mounting member such as a hook on the mounted article and connecting this mounted article mounting member with a mounting location mounting member such as a hook provided on the mounting location such as a wall.

With such a method, the condition of the mounted article may be inappropriate when the mounted article is mounted at the mounting location by connection of the mounted article mounting members and the mounting location mounting members, owing to inappropriate positioning of the mounted article mounting members or mounting location mounting members.

Usually however the mounted article mounting members are fixed to the mounted article or the mounting location mounting members are fixed to the mounting location. There was therefore the problem that it was not possible to put the mounted article in an appropriate mounted condition by moving the connection position of the mounted article mounting members and mounting location mounting members with respect to the mounted article or mounting location by moving the mounted article mounting members on the mounted article or by moving the mounting location mounting members on the mounting location.

This problem will be described in specific terms taking the example of an inner bag for a cargo accommodating space that is mounted on the side faces of a container. An inner bag for a cargo accommodating space is a bag that is mounted in the cargo accommodating space of a container when granular or powdered material is transported in a container or the like, and is disclosed in for example Japanese Unexamined Utility Model Publication No.5-62490.

Such an inner bag for a cargo accommodating space comprises a bag body. In expanded condition, this bag body has the shape of an approximately rectangular prism or parallelpiped mounted in the cargo accommodating space of a container. Also, with such an inner bag, hook-shaped mounting members constituting inner bag mounting members (mounted article mounting members) are fixed in the vicinity of the junction lines between the ceiling face covering the ceiling of the container and the respective left and right side faces covering the left and right side walls of the container. In the case of this inner bag, the bag body is then mounted within the container by expanding the bag in the container and connecting up the hook-shaped mounting members to the container mounting members (mounting location mounting members) that are provided in the vicinity of the junction between the container ceiling and the left and right side walls respectively.

However, the positions of mounting of the container mounting members in the depth direction of the container are not standardized between different types of container or containers of different manufacturers. As a result, with this inner bag, when the inner bag was attempted to be mounted on the container by connecting up the hook-shaped mounting members fixed to the inner bag with the container mounting members, it sometimes happened that the bag was held in a slack condition. As a result, there was the problem that in some cases it was not possible to mount the inner bag in the correct condition.

Thus, when the inner bag was mounted on the container with the bag in this inappropriate, slack condition, when the cargo was introduced, the cargo introduction mechanism such as a blower or conveyor that was used to introduce the cargo into the bag might come in contact with the bag, damaging the bag. Also, when cargo entered such a sagging bag, force was applied to the bag in non-uniform manner, which could cause the bag to rupture. It is therefore very important to mount the inner bag in a correct condition within the cargo-accommodating space in the interior of the container or the like.

The same kind of problems also arose when a curtain for the cargo accommodating space for preventing water damage of the cargo within the container by formation of condensation on the inside wall of the container was mounted within the cargo accommodating space within the container.

In view of the above problems, an object of the present invention is to provide a mounting device whereby a mounted article can be mounted in a desired condition by making the position of the mounting members movable and an inner bag for a cargo accommodating space provided with such a mounting device, or a curtain for preventing water damage for a cargo accommodating space.

SUMMARY OF THE INVENTION

A key features of the present invention resides in that a fastener having a flexible track such as was conventionally employed as means for opening and closing is employed to effect movement of the position of mounting members.

According to a first aspect of the present invention, a mounting device comprises a fastener having at least one slider and a flexible track that is opened and closed by sliding of this slider and a mounting member that is connected to the slider.

With this construction, the mounting member is moved along the flexible track by sliding of the slider along the flexible track of the fastener.

When a mounting device according to the present invention is mounted on a mounted article or a mounting location, the mounting member of the mounting device of the present invention is a mounted article mounting member or mounting location mounting member. Consequently, according to the present invention, a mounted article mounting member or mounting location mounting member can be moved along the flexible track of a fastener. By means of this movement, the mounting condition of the mounted article can be made to assume a desired mounting condition.

Also, since the track of this mounting device is flexible, when the mounted article or mounting location on which the mounting device of the present invention is mounted are capable of being folded up, the mounting device does not impair the character of the mounted article or mounting location of being capable of being folded up.

It should be noted that, when this mounting member is a mounted article mounting member, this mounting member is capable of engagement with a mounting location mounting member and when this mounting member is a mounting location mounting member, this mounting member is capable of engagement with a mounted article mounting member.

In putting the present invention into practice, the fastener is preferably a sliding fastener.

In putting the present invention into practice, preferably a resilient member that is capable of elongation and contraction is provided between the slider and the mounting member. The resilient member may be for example an annular rubber member or spring.

With such a construction, the mounted article mounting member or mounting location mounting member is connected to the slider by means of a resilient member that is capable of elongation and contraction. As a result, the operation of connecting the mounted article mounting members to the mounting location mounting members or the mounting location mounting members to the mounted article mounting members is facilitated.

Furthermore, since the resilient member functions as a buffer member between the mounting location and the slider, it protects the fastener from damage.

In putting the present invention into practice, preferably the slider comprises a pull and the mounting member is connected to the pull.

In putting the present invention into practice, preferably the sliding fastener has at least two sliders, the two sliders form a pair and are arranged adjacently on the flexible track and one of the mounting members is connected to both of two adjacently arranged sliders.

By means of this construction, the load applied to the mounting members is dispersed to the two sliders. Also, since a single mounting member is connected to two sliders, unintended movement of a mounting member along the track is reduced.

In putting the present invention into practice, preferably a plurality of pairs of sliders are arranged on the flexible track and one in each case of said mounting members are respectively connected to each of the slider pairs.

With this construction, the plurality of mounting members are arranged so as to be capable of movement along the flexible track.

In putting the present invention into practice, preferably two sliders constituting the pair are adjacently arranged on the flexible track such that the flexible track is in open condition between the two sliders. With this construction, the flexible track is always in a closed condition before and after the two adjacently arranged sliders.

In putting the present invention into practice, preferably the mounting member is provided with a hook.

In putting the present invention into practice, preferably the mounting member is an annular member.

According to the second aspect of the present invention, there is provided an inner bag for a cargo accommodating space. The inner bag for a cargo accommodating space comprises a bag body mounted within the cargo accommodating space and connecting elements for mounting this bag body in a container in expanded condition. In the inner bag of the present invention, a mounting device comprising a fastener having at least one slider and a flexible track that is opened or closed by sliding of this slider, and mounting members capable of engagement with a mounting location mounting member provided in the cargo accommodating space and connected to the slider, are provided on the connecting element.

With this construction, movement of the mounting members along the inner bag is effected along the flexible track by sliding the sliders along the flexible track of the fastener. Consequently, the inner bag mounting members can be moved matching the positions of the mounting location mounting members provided in the cargo accommodating space. As result, the inner bag can be mounted in the cargo accommodating space with the bag body in suitably expanded condition. Also, since the track is flexible, there is no obstruction when the inner bag is folded up to put it away.

In putting the present invention into practice, preferably the fastener is a sliding fastener.

In putting the present invention into practice, preferably a resilient member that is capable of elongation and contraction is provided between the slider and the mounting member. This resilient member may be for example an annular rubber element or member or a spring.

By means of this construction, the operation of connecting the mounting members of the inner bag to the mounting location mounting members in the cargo accommodating space is facilitated.

Furthermore, since the resilient member functions as a buffer member between the mounting location and the slider, it protects the fastener from damage.

In putting the present invention into practice, preferably the slider is provided with a pull, and the mounting member is connected to the pull.

In putting the present invention into practice, preferably the sliding fastener comprises at least two sliders, two sliders constitute a pair and are arranged adjacently on the flexible track, and one mounting member is connected to both of the two adjacently arranged sliders.

By means of this construction, the load applied to the mounting members is dispersed to the two sliders. Also, since a single mounting member is connected to two sliders, unintended movement of a mounting member along the track is reduced.

In putting the present invention into practice, preferably a plurality of pairs of the sliders are arranged on a flexible track, and one in each case of the mounting members are connected respectively to each pair of sliders.

By means of this construction, a plurality of mounting members can be movably arranged on the flexible track.

In putting the present invention into practice, preferably two sliders constituting the pair are arranged adjacently on the flexible track such that the flexible track is in open condition between the two sliders.

With this construction, the flexible track is always in closed condition before and after the two adjacently arranged sliders.

In putting the present invention into practice, preferably the mounting members comprise hooks that are engageable with the mounting location mounting members provided in the cargo accommodating space.

In putting the present invention into practice, preferably the mounting members are annular members that are engageable with the mounting location mounting members provided in the cargo accommodating space.

According to the third aspect of the present invention, there is provided a curtain for a cargo accommodating space. The curtain prevents water damage to the cargo accommodating space and comprises a top face that runs along the ceiling of the cargo accommodating space, left and right side faces that run along the left and right sides of the cargo accommodating space, a rear face that runs along the rear of the width direction of the cargo accommodating space, and a front face that runs along the front of the cargo accommodating space, and a connecting element mounted in the cargo accommodating space with the curtain in expanded condition. A mounting device for the curtain includes a fastener having at least one slider and a flexible track that is opened and closed by sliding of this slider and a mounting member that is capable of engagement with a mounting member provided in the cargo accommodating space and connected to the slider, is provided on the connecting element.

By means of this construction, movement of the mounting members along the water damage preventing curtain is effected along the flexible track by sliding the sliders along the flexible track of the fastener. Consequently, the water damage preventing curtain mounting members can be moved matching the positions of the mounting location mounting members provided in the cargo accommodating space. As result, the water damage preventing curtain can be mounted in the cargo accommodating space with the bag body in suitably expanded condition. Also, since the track is flexible, there is no obstruction when the water damage preventing curtain is folded up to put it away.

In putting the present invention into practice, preferably the fastener is a sliding fastener.

In putting the present invention into practice, preferably a resilient member that is capable of elongation and contraction is provided between the slider and the mounting member. The resilient member may be for example an annular rubber member or a spring.

By means of this construction, the operation of connecting the mounting members of the water damage preventing curtain to the mounting location mounting members in the cargo accommodating space is facilitated.

Furthermore, since the resilient member functions as a buffer member between the mounting location and the slider, it protects the fastener from damage.

In putting the present invention into practice, preferably the slider is provided with a pull, and the mounting member is connected to the pull.

In putting the present invention into practice, preferably the sliding fastener comprises at least two sliders, two sliders constitute a pair and are arranged adjacently on the flexible track, and one mounting member is connected to both of the two adjacently arranged sliders.

By means of this construction, the load applied to the mounting members is dispersed to the two sliders. Also, since a single mounting member is connected to two sliders, unintended movement of a mounting member along the track is reduced.

In putting the present invention into practice, preferably a plurality of the pairs of sliders are arranged on the flexible track, and the mounting members are connected, one in each case, to respective pairs of sliders.

By means of this construction, a plurality of mounting members are movably arranged along a flexible track.

In putting the present invention into practice, preferably the paired sliders are arranged adjacently on this flexible track such that the flexible track is in an open condition between the two sliders.

With this construction, the flexible track is always in a closed condition before and after the two adjacently arranged sliders.

In putting the present invention into practice, preferably the mounting members comprise hooks that are engageable with the mounting location mounting members provided in the cargo accommodating space.

In putting the present invention into practice, preferably the mounting members are annular members that are engageable with the mounting location mounting members provided in the cargo accommodating space.

BRIEF DESCRIPTION OF THE DRAWINGS

The foregoing and other objects, features and advantages of the present invention will be better understood from the following description taken in connection with accompanying drawings, in which.

DESCRIPTION OF THE PREFERRED EMBODIMENTS

Figure 1:
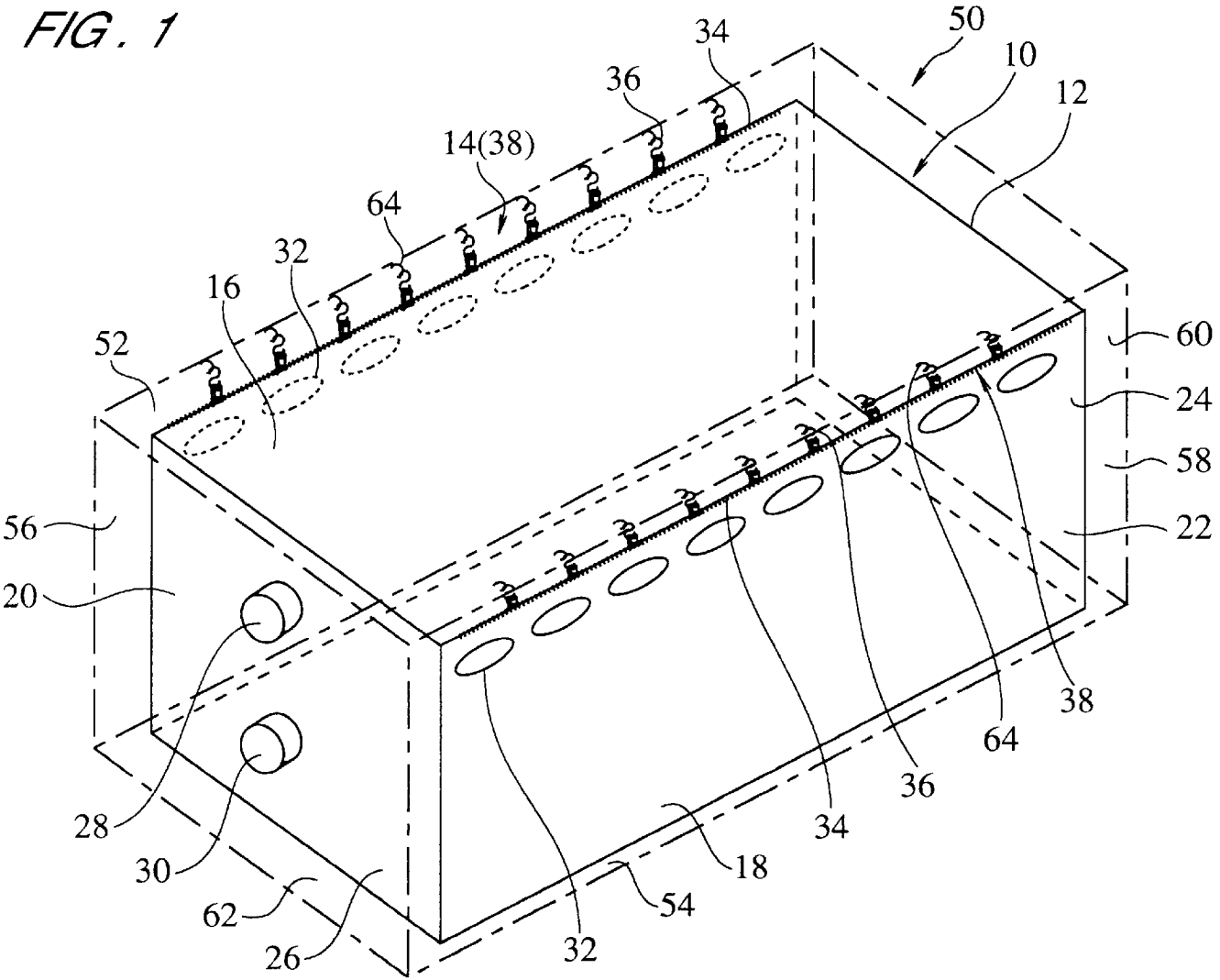
FIG. 1 is a perspective view showing a condition in which an inner bag for a container according to a first embodiment of the present invention is mounted within a container.

Embodiments of the present invention are hereinafter described with reference to the drawings. It should be noted that, in the drawings, the size, shape and positional relationship of the structural elements are only shown schematically and diagrammatically so as to enable the invention to be understood. The present invention is therefore not restricted to the embodiments shown in the drawings.

(First Embodiment)

Figure 2:
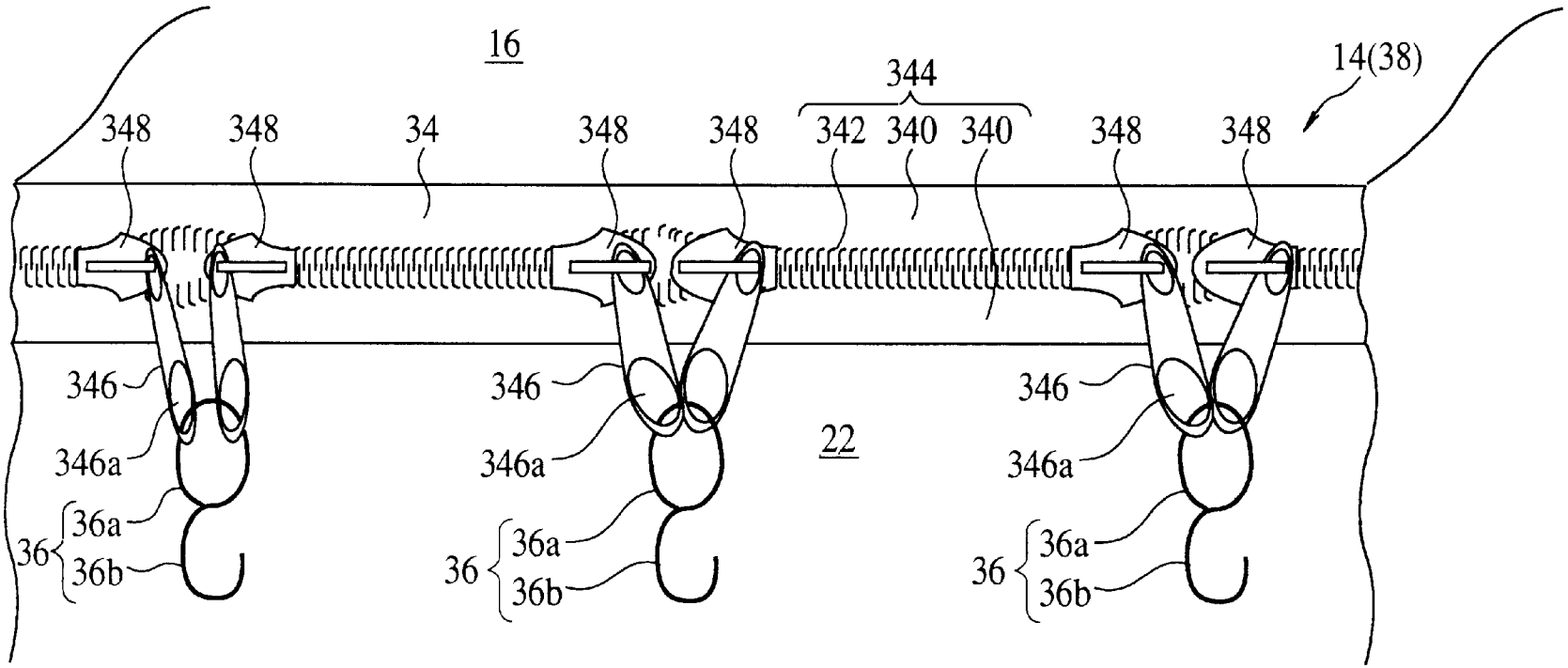
FIG. 2 is a view to a larger scale showing part of a mounting device provided on the inner bag of FIG. 1.

FIG. 1 is a perspective view showing an inner bag 10 for a container according to a first embodiment of the present invention mounted within a container 50. FIG. 2 is a view to a larger scale of a mounting device 38 provided on the inner bag 10 of FIG. 1.

As can be seen from FIG. 1, an inner bag 10 for a container according to a first embodiment of the present invention is constituted such that it can be mounted within the cargo accommodation space of a container 50 for cargo transportation which is of rectangular prismatic or parallelpiped shape and is shown by the chain dotted line. The inner bag 10 is constructed such that it can accommodate in its interior contents such as grains, malt, various types of synthetic resin or powders of their raw material or granular materials such as pellets or powder-form material.

Inner bag 10 comprises a bag body 12 and a connecting element 14 that connects bag body 12 and the container 50. Inner bag 10 is mounted within the container in a condition with bag body 12 expanded and connected to container 50 through connecting element 14.

When bag body 12 is installed within rectangular prismatic or parallelpiped container 50, it has an approximately rectangular prismatic or parallelpiped shape surrounding the cargo accommodating space within container 50. Specifically, bag body 12 comprises a top face 16 that covers the ceiling 52 of container 50, a bottom face 18 that covers the floor 54 of container 50, a left side face 20 and right side face 22 that respectively cover the left side wall 56 and right side wall 58 in the longitudinal direction of container 50, a rear face 24 that covers the rear wall 60 of container 50, and a front face 26 that covers the front wall 62 of container 50. Bag body 12 is made of for example polyethylene but the material properties could be suitably altered depending on the conditions of use, such as the type of contents accommodated. The front wall 62 of this container 50 can be opened and closed.

An introduction unit 28 is provided in the upper part of the front face 26 of bag body 12. A discharge unit 30 is provided in the lower part of the front face 26 of bag body 12. Introduction unit 28 and discharge unit 30 are both tubular units connected to the inside space of bag body 12 and are employed when contents are discharged from or introduced into bag body 12. Also, introduction unit 28 and discharge unit 30 are constructed so that they can be closed when not needed by closure means, not shown.

A plurality of ventilation ports 32 are provided in the upper parts of left and right side faces 20, 22 of bag body 12.

Connecting elements 14 are provided along the junction line between the left side face 20 and top face 16 of bag body 12 and along the junction line between the right side face 22 and top face 16. These connecting elements 14 comprise a mounting device 38 that is provided with a slide or sliding fastener 34 and mounting member 36.

As can be understood from FIG. 2, sliding fastener 34 is a known sliding fastener also known as a zip fastener, zipper or zip. Sliding fastener 34 is provided with a track 344. This track 344 is formed by a pair of tapes 340, 340 and a plurality of function teeth i.e. teeth 342 anchored in these tapes. Track 344 is flexible since these tapes 340 are constituted of flexible material such as cloth. Sliding fastener 34 is mounted on inner bag 10 by sewing tape 340 to bag body 12. It should be noted that this method of mounting is not restricted to sewing and for example melt-bonding or adhesion by an adhesive could be employed.

Also, sliding fastener 34 is provided with a slider 348 having a pull 346. Slider 348 is arranged to be capable of sliding along track 344. As in a conventional sliding fastener, in this sliding fastener 34 also, track 344 is opened or closed by mutual engagement or separation of function teeth 342 that are arranged facing each other by sliding of slider 348 along track 344. In this embodiment the function teeth 342 and slider 348 of sliding fastener 34 are made of synthetic resin, but they could be made of metal or other material.

An aperture 346*a* is formed on pull 346. A mounting member 36 is mounted in this aperture 346*a*. In the case of inner bag 10 according to this embodiment, two sliders 348 are arranged adjacently on track 344 such that track 344 is in open condition between these two sliders 348. A single mounting member 36 is mounted in respect of a pair of sliders consisting of two sliders 348, 348 arranged adjacent each other.

As can be seen from FIG. 2, mounting member 36 comprises a ring-shaped portion 36*a* and a hook-shaped portion 36*b*. In the case of inner bag 10 of this embodiment, mounting member 36 is connected to the pair of sliders 348, 348 by ring-shaped portion 36*a* of mounting member 36 being passed through the apertures 346*a* of respective pulls 346 of the pair of adjacently arranged sliders 348, 348.

There are no particular restrictions on the material of mounting member 36 and a suitable choice may be made in accordance with requirements from various materials such as metal or synthetic resin.

Also, as can be seen from FIG. 1, inner bag 10 is mounted on container 50 in a condition with bag body 12 expanded, by connecting hooks 36*b* of mounting members 36 with container mounting members 64 of hook- or C-shape provided at the top of left and right side walls 56, 58 of container 50. That is, inner bag 10 is hung on the inner wall of container 50 by mounting member 36 with container mounting member 64.

Consequently, the shape of the mounting members on the side of the inner bag is not restricted to the shape of mounting members 36 but could be suitably selected in accordance with the shape of container mounting members 64.

Inner bag 10 of this embodiment can move along track 344 of sliding fasteners 34 since mounting members 36 are connected to sliders 348 through pulls 346. Furthermore, since tapes 340 are made of flexible material, sliding fasteners 34 present no obstruction when bag body 12 is folded up.

Next, mounting of inner bag 10 on to container 50 will be described with reference to FIGS. 3(A), (B) and (C).

Figure 3A:
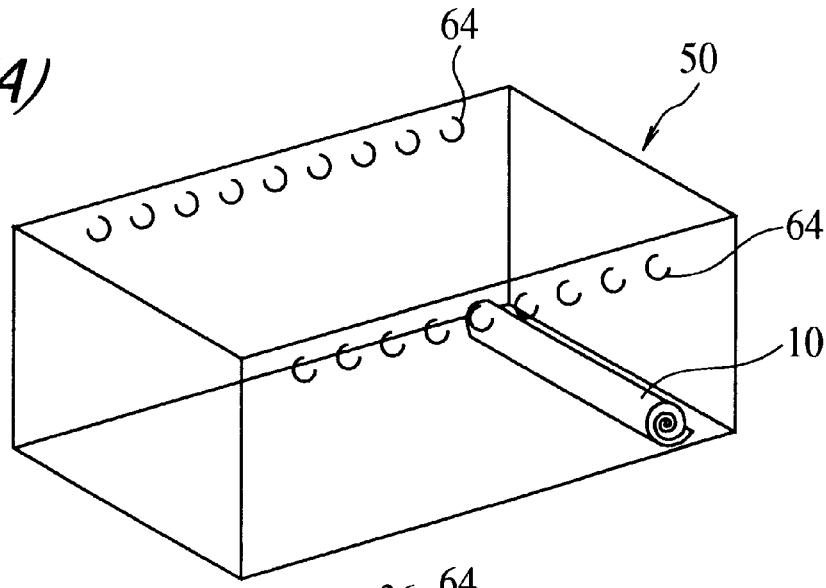
FIG. 3(A), (B) and (C) are views showing how an inner bag is mounted on a container.
Figure 3B:
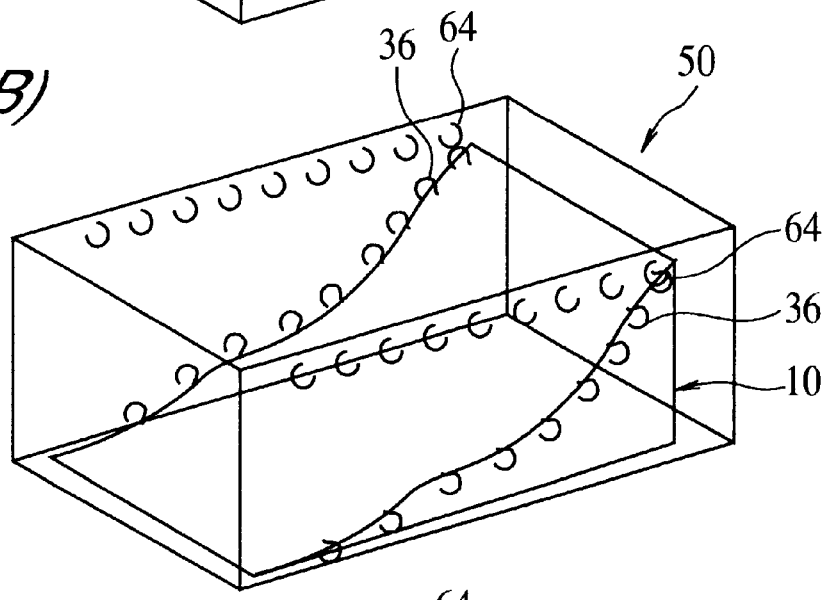
Figure 3C:
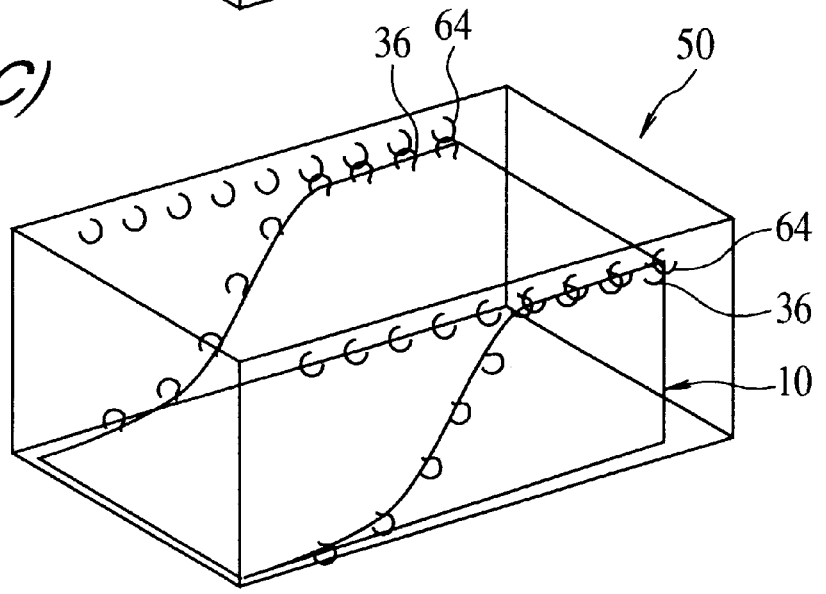

First of all, as shown in FIG. 3(A), inner bag 10 is rolled up into a roll shape and arranged at the back of container 50. Next, while unwinding inner bag 10, as shown in FIG. 3(B), inner bag 10 is mounted within container 50 (FIG. 3(C)), by engaging hooks 36*b* of mounting members 36 from the back i.e. the rear wall side of container 50 on container mounting members 64 provided in the upper part of the left and right side walls of container 50.

As described above, the positions of arrangement of container mounting members 64 in the depth direction of container 50 may be different for each container, but, with this inner bag 10, mounting members 36 that are connected to container mounting members 64 are movable. Consequently, inner bag 10 can be mounted within container 50 by putting bag body 12 into a desired expanded condition by moving mounting members 36, matched in position with the positions of container mounting members 64.

Also, the operation of mounting inner bag 10 can be carried out in an extremely simple manner, since mounting members 36 can be moved simply by pulling pulls 346 of sliders 348 or mounting members 36.

The number of mounting members 36 or sliders 348 mounted on mounting devices 38 of this embodiment can be suitably determined in accordance with the size of inner bag 10 and the conditions of use.

Figure 4:
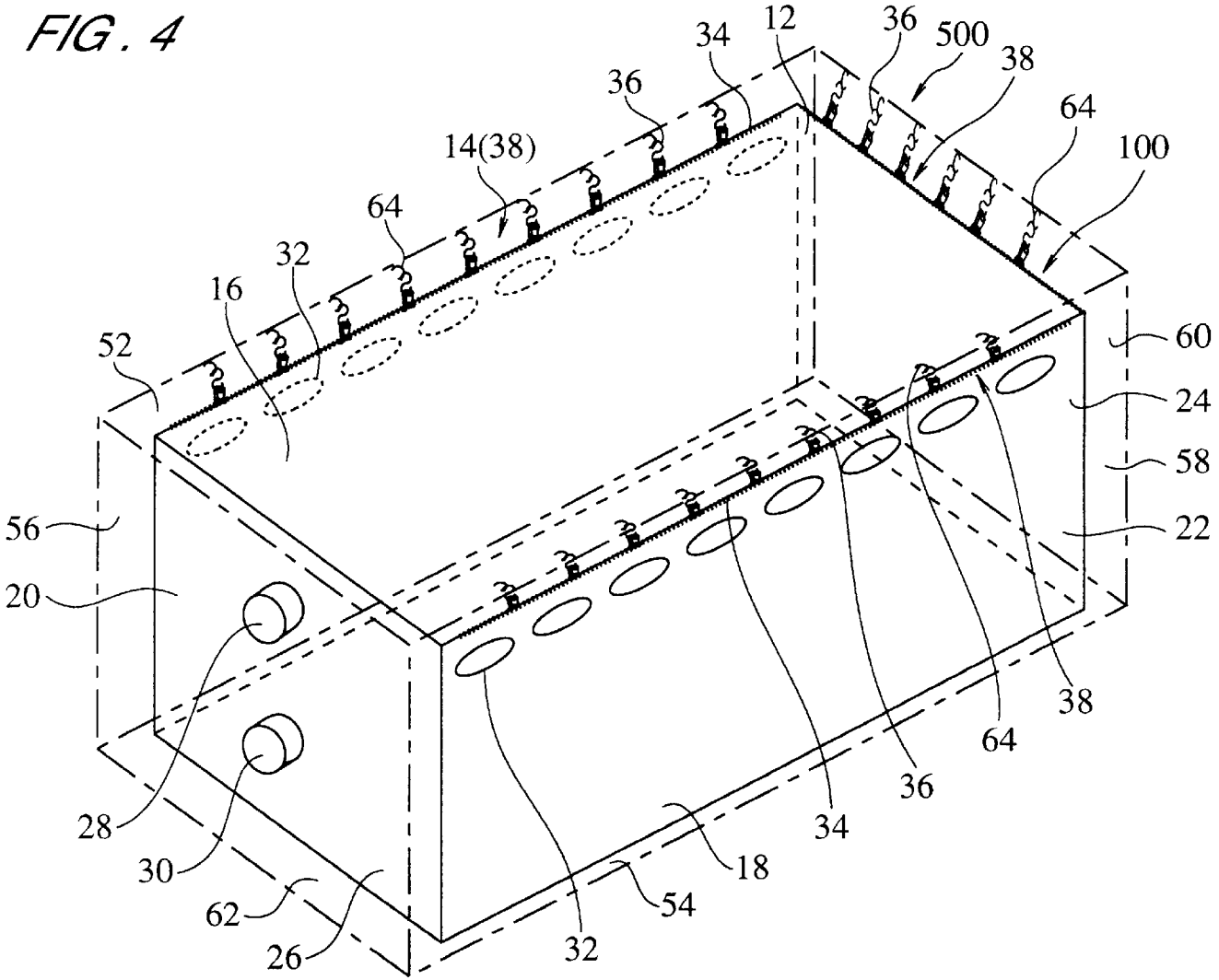
FIG. 4 is a perspective view showing an inner bag according to a modified example of the inner bag of FIG. 1 mounted within a container.

FIG. 4 is a perspective view showing a condition in which an inner bag 100 constituting a modification of inner bag 10 is mounted within container 500.

Inner bag 100 differs from inner bag 10 in that mounting devices 38 are also provided on the junction line between top face 16 and rear face 24.

When inner bag 100 constructed in this way is mounted on a container 500 provided with container mounting members 64 at the top part of the rear wall 60 also, the mounting members 36 of mounting devices 38 provided at the junction line between top face 16 and rear face 24 are connected with container mounting members 64 provided in the upper part of rear wall 60. Mounting members 36 of mounting devices 38 provided on the junction line between top face 16 and rear face 24 can then be moved in the width direction of bag body 12, matching the positions of container mounting members 64 provided on rear wall 60.

Also, mounting devices 38 provided on the junction line between top face 16 and left face 20, mounting devices 38 provided on the junction line between top face 16 and rear face 24, and mounting devices 38 provided on the junction line between top face 16 and right face 22 may be integrated. Specifically, a single slide fastener 34 may be arranged so as to extend from the junction line between the top face 16 and left face 20, through the junction line between top face 16 and rear face 24, to the junction line between top face 16 and right face 22. With such a construction, sliders 348 on which mounting members 36 are mounted can move freely along the junction line between top face 16 and left face 20, along the junction line between top face 16 and rear face 24 and along the junction line between top face 16 and right face 22.

Figure 5:
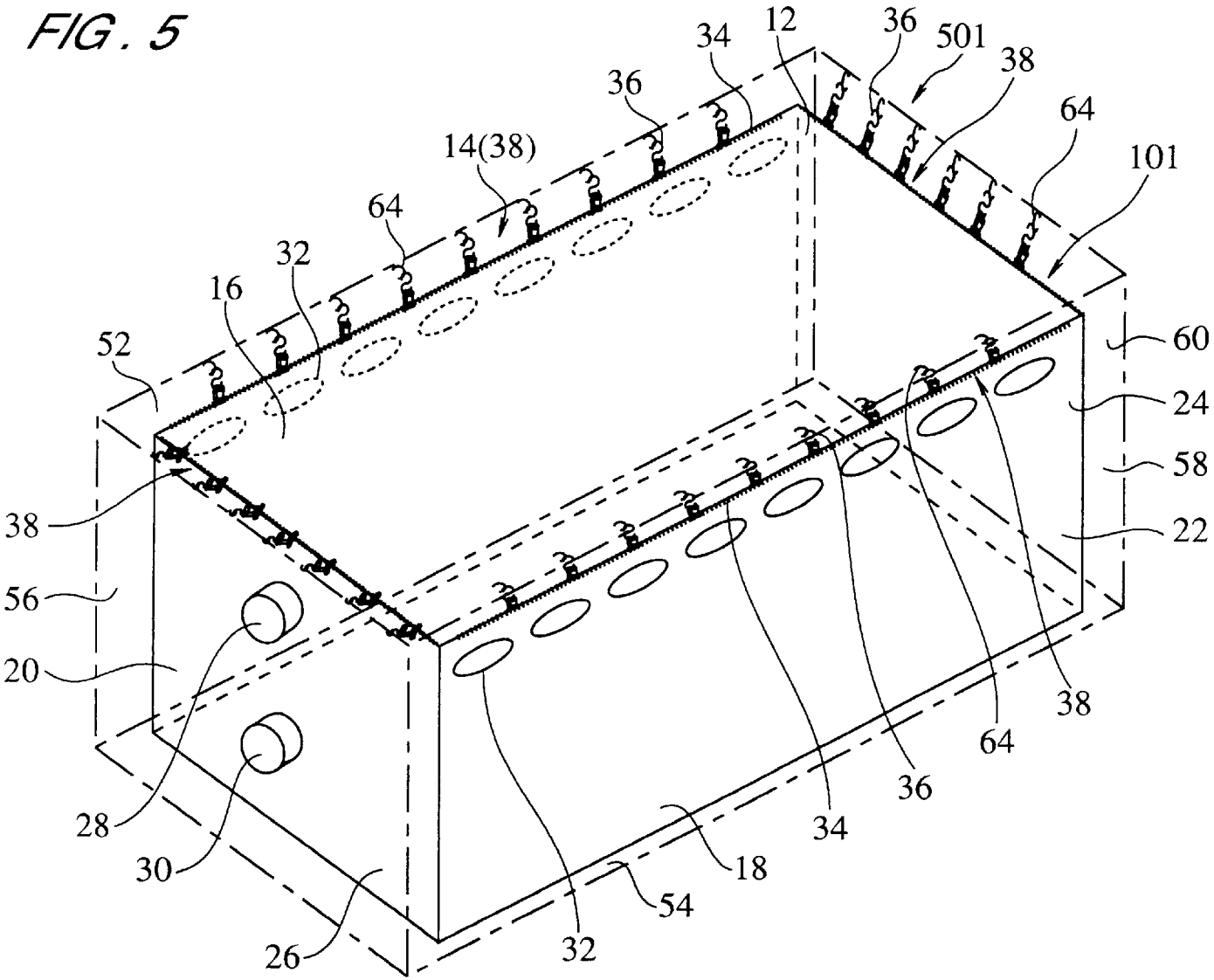
FIG. 5 is a perspective view of another modified example of the inner bag of FIG. 1 mounted within the container.

Furthermore, if required, in addition to the construction of inner bag 10 or inner bag 100, as shown in FIG. 5, an inner bag 101 may be constituted provided with mounting devices 38 on the junction line between top face 16 and front face 26. Inner bag 101 is hung on the inner wall of container 501. In this case also, mounting devices 38 provided on the junction line between top face 16 and front face 26 may be integrated with mounting devices 38 provided on the junction line between top face 16 and left face 20, and with mounting devices 38 provided on the junction line between top face 16 and right face 22.

Figure 6:
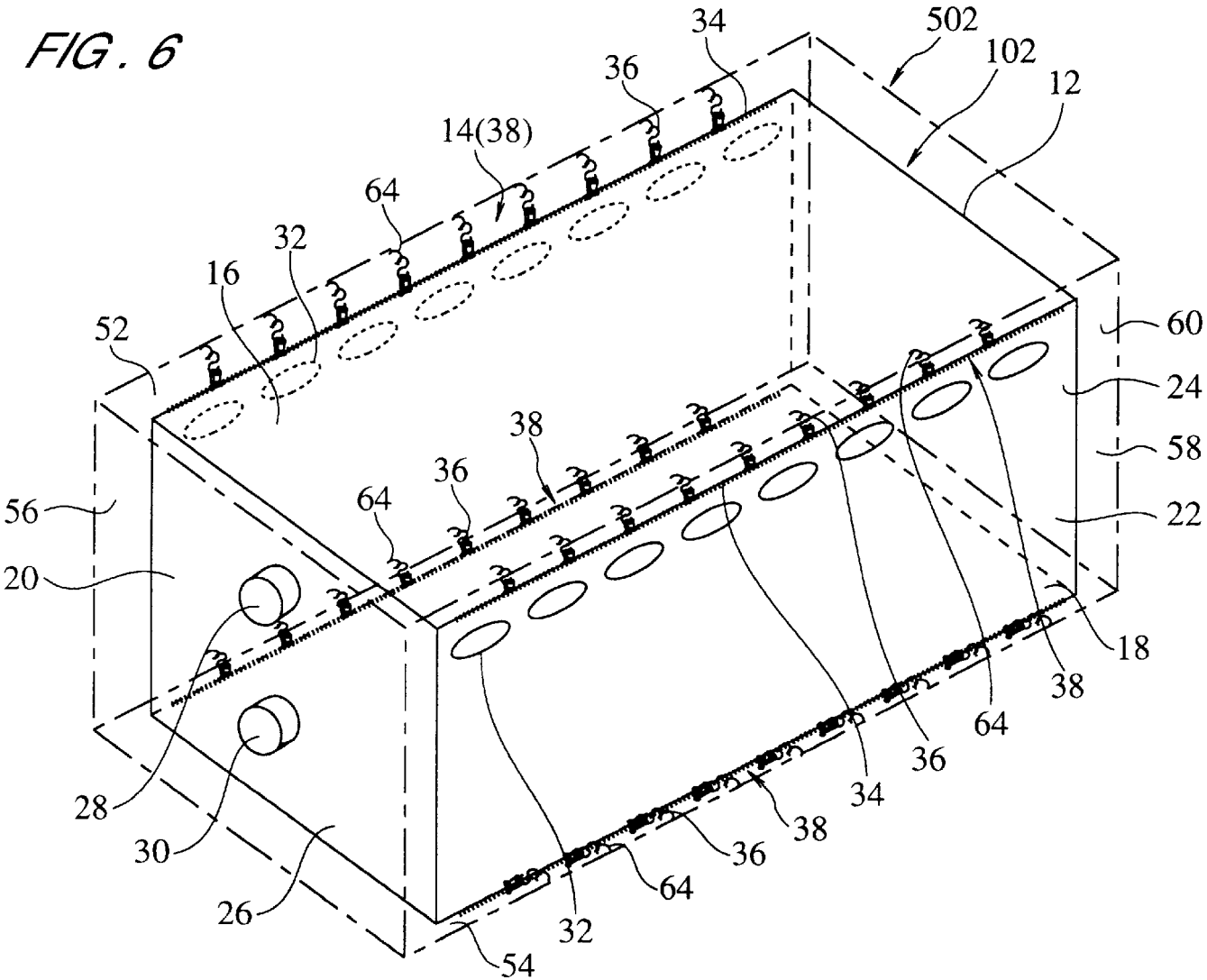
FIG. 6 is a perspective view of an inner bag according to a further modification of the inner bag of FIG. 1 mounted within the container.

FIG. 6 is a perspective view showing a condition in which an inner bag 102 constituting a further modification of inner bag 10 is mounted within container 502.

Inner bag 102 differs from inner bag 10 in that mounting devices 38 are provided on the junction line between bottom face 18 and left face 20 and also between bottom face 18 and right face 22.

When an inner bag 102 constructed in this way is mounted on a container 502 provided with container mounting devices 64 in the lower part of left and right walls 56, 58, the mounting members 36 of mounting devices 38 provided on the junction line between bottom face 18 and left face 20 and on the junction line between bottom face 18 and right face 22 are connected to container mounting members 64 provided on the lower part of left and right walls 56 and 58 of container 502.

Mounting members 36 of mounting devices 38 provided on the junction line between bottom face 18 and left face 20 and the junction line between bottom face 18 and right face 22 are moved matching the positions of container mounting members 64 provided in the lower parts of left and right walls 56, 58 of container 502.

(Second Embodiment)

Figure 7:
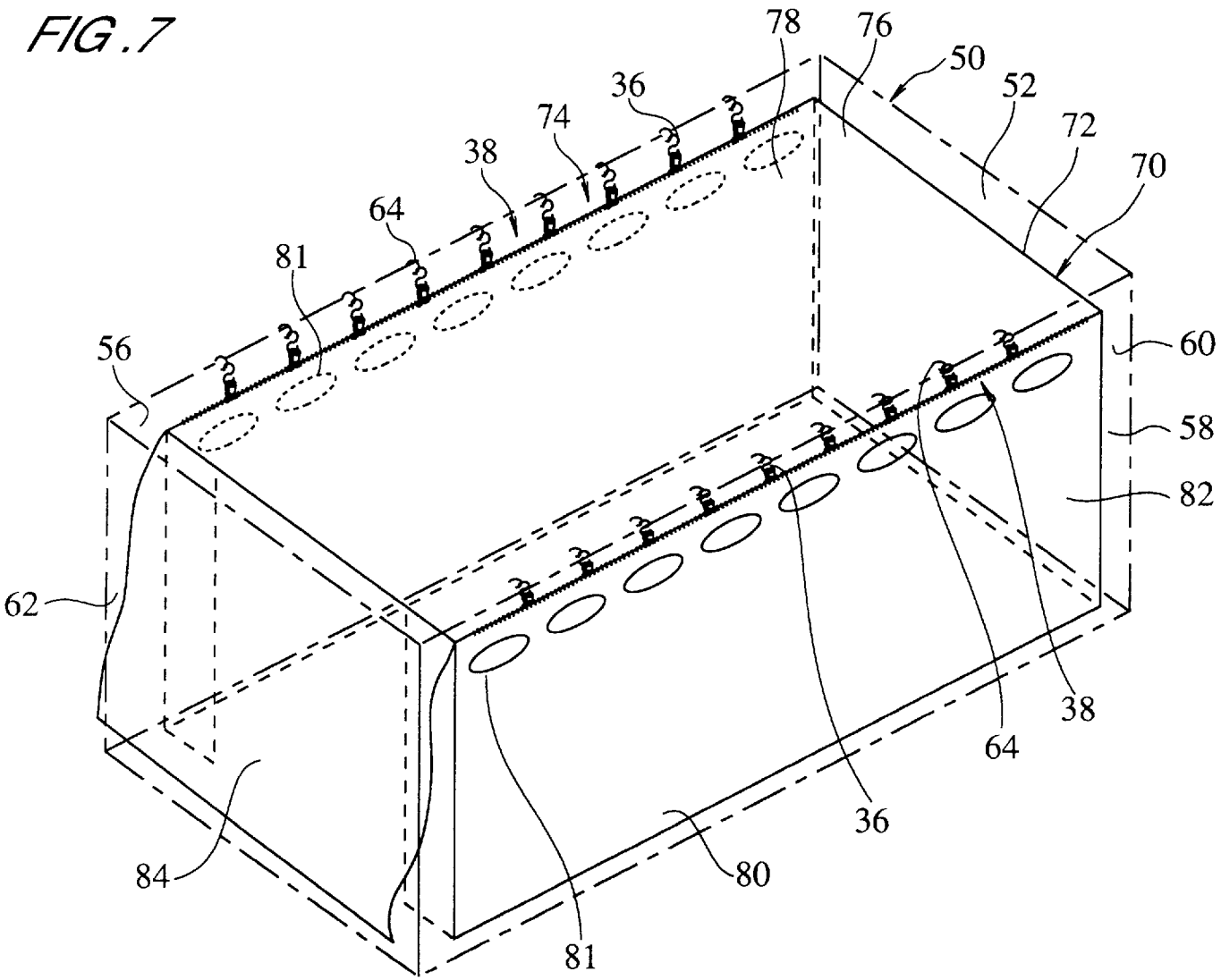
FIG. 7 is a perspective view of a water damage preventing curtain for a container according to a second embodiment of the present invention mounted within the container.

FIG. 7 is a perspective view showing the condition in which a water damage preventing curtain 70 for a container according to a second embodiment of the present invention is mounted within a container 50.

As can be seen from FIG. 7, water damage preventing curtain 70 for a container according to a second embodiment of the present invention is constituted such that it can be mounted in a cargo accommodating space within a rectangular prismatic container 50 shown by the single-dotted chain lines, in the same way as inner bag 10 according to the first embodiment. The water damage preventing curtain is a known curtain mounted within a container to prevent cargo within the container being wetted by formation of condensation etc. on the inside wall of the container.

Water damage preventing curtain 70 comprises a curtain 72 and a connecting element 74 whereby curtain 72 is connected with container 50. Water damage preventing curtain 70 is connected with container 50 by means of connecting element 74 and is mounted within the container in a condition with curtain 72 expanded. On connecting element 74, there are provided mounting devices 38 of the same construction as mounting devices 38 provided on connecting element 14 of inner bag 10 as described above, by the same method as in the case of the first embodiment.

When installed in rectangular prismatic container 50, curtain 72 has a practically rectangular prismatic shape covering the inside of container 50. Specifically, curtain 72 comprises a top face 76 that covers ceiling 52 of container 50, left face 78 and right face 80 that respectively cover the left wall 56 and right wall 58 in the longitudinal direction of container 50, rear face 82 that covers the rear wall 60 of container 50, and front face 84 that covers the front face 62 of container 50. Curtain 72 is constructed of waterproof material, for example polyethylene. However, this material may be suitably changed, depending on the conditions of use, such as the type of contents to be accommodated. The front wall 62 of this container 50 is capable of being opened and closed. The front face 84 of curtain 72 is not connected with left face 78 and right face 80.

A plurality of ventilation ports 81 are provided in the upper parts of left and right faces 78 and 80 of curtain 72.

This wet damage preventing curtain 70 differs from inner bag 10 in that: it is not provided with a bottom face covering the floor of container 50; front face 84 that lies along front wall 62 of container 50 is not connected with left and right faces 78 and 80 that run along side walls 56, 58 of container 50; and in that no introduction unit or discharge unit are provided.

However, the construction and mounting positions of mounting devices 38 and, in addition, the method of mounting on to container 50 are the same as in the case of inner bag 10.

Consequently, wet damage preventing curtain 70 can be mounted in container 50 with curtain 72 in a desired expanded condition by moving mounting members 36 of mounting devices 38 into positions matching the positions of container mounting members 64.

Also, since mounting members 36 can be moved simply by pulling mounting members 36 or the pulls of the sliders etc., the operation of mounting wet damage preventing curtain 70 on to container 50 can be carried out in an extremely simple manner.

The number of mounting members 36 mounted on mounting devices 38 of this embodiment is suitably determined in accordance with the conditions of use and the size of wet damage preventing curtain 70.

Figure 8:
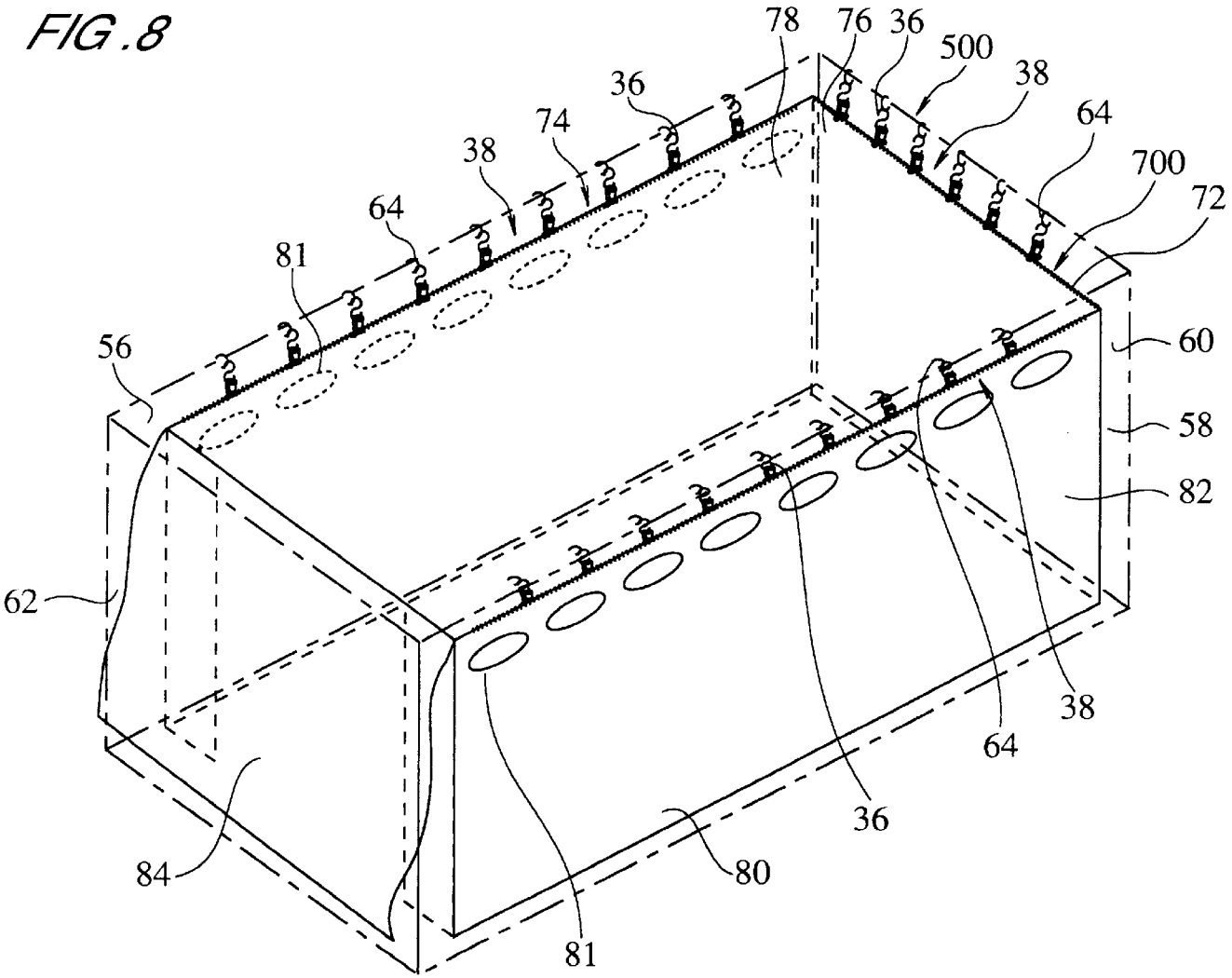
FIG. 8 is a perspective view of a water damage preventing curtain according to a modification of the water damage curtain of FIG. 7 mounted within the container.

FIG. 8 is a perspective view showing the condition when water damage preventing curtain 700, which is a modified example of water damage preventing curtain 70, is mounted in container 500.

Water damage preventing curtain 700 differs from water damage preventing curtain 70 in that mounting devices 38 are provided also on the joining line between top face 76 and rear face 82.

When water damage preventing curtain 700 for a container of this construction is mounted in a container 500 provided with container mounting members 64 in the upper part of the rear wall 60, mounting members 36 of mounting devices 38 provided on the junction line between top face 76 and rear face 82 are connected with container mounting members 64 provided in the top part of rear wall 60. Mounting members 36 of mounting devices 38 provided at the junction line between top face 76 and rear face 82 are then movable in the width direction of curtain 72 matching the positions of container mounting members 64 in the rear wall 60.

Also, mounting devices 38 provided on the junction line between top face 76 and left face 78, mounting devices 38 provided on the junction line between top face 76 and rear face 82, and mounting devices 38 provided on the junction line between top face 76 and right face 80 may be integrated. Specifically, a single sliding fastener 34 may be arranged so as to extend from the junction line between top face 76 and left face 78 through the junction line between top face 76 and rear face 82 to the junction line between top face 76 and right face 80. With this construction, sliders 348 mounted on mounting members 36 can freely move along the junction line between top face 76 and left face 78, the junction line between top face 76 and rear face 82, and along the junction line between top face 76 and right face 80.

Figure 9:
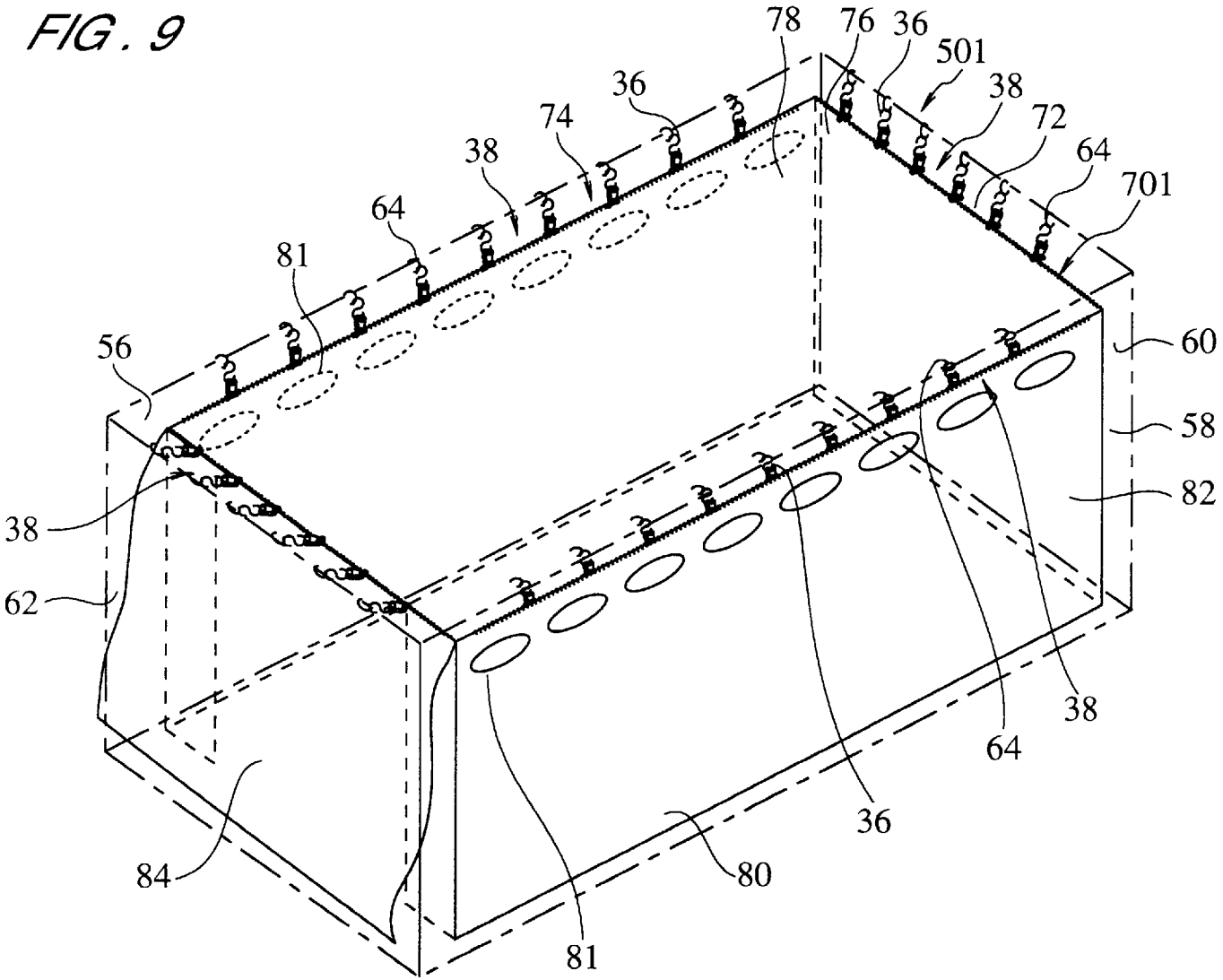
FIG. 9 is a perspective view of a water damage preventing curtain according to a further modification of the water damage preventing curtain of FIG. 7 mounted within the container.

Furthermore, if required, in addition to the construction of water damage preventing curtain 70 and water damage preventing curtain 700, as shown in FIG. 9, a water damage preventing curtain 701 may be constituted wherein mounting devices 38 are provided on the junction line between top face 76 and front face 84. Curtain 70 is hung on the inner wall of container 501. In this case also, mounting devices 38 that are provided on the junction line between top face 76 and front face 84 may be made integral with the mounting devices 38 provided on the junction line between top face 76 and left face 78 and the mounting devices 38 provided on the junction line between top face 76 and right face 80.

Figure 10:
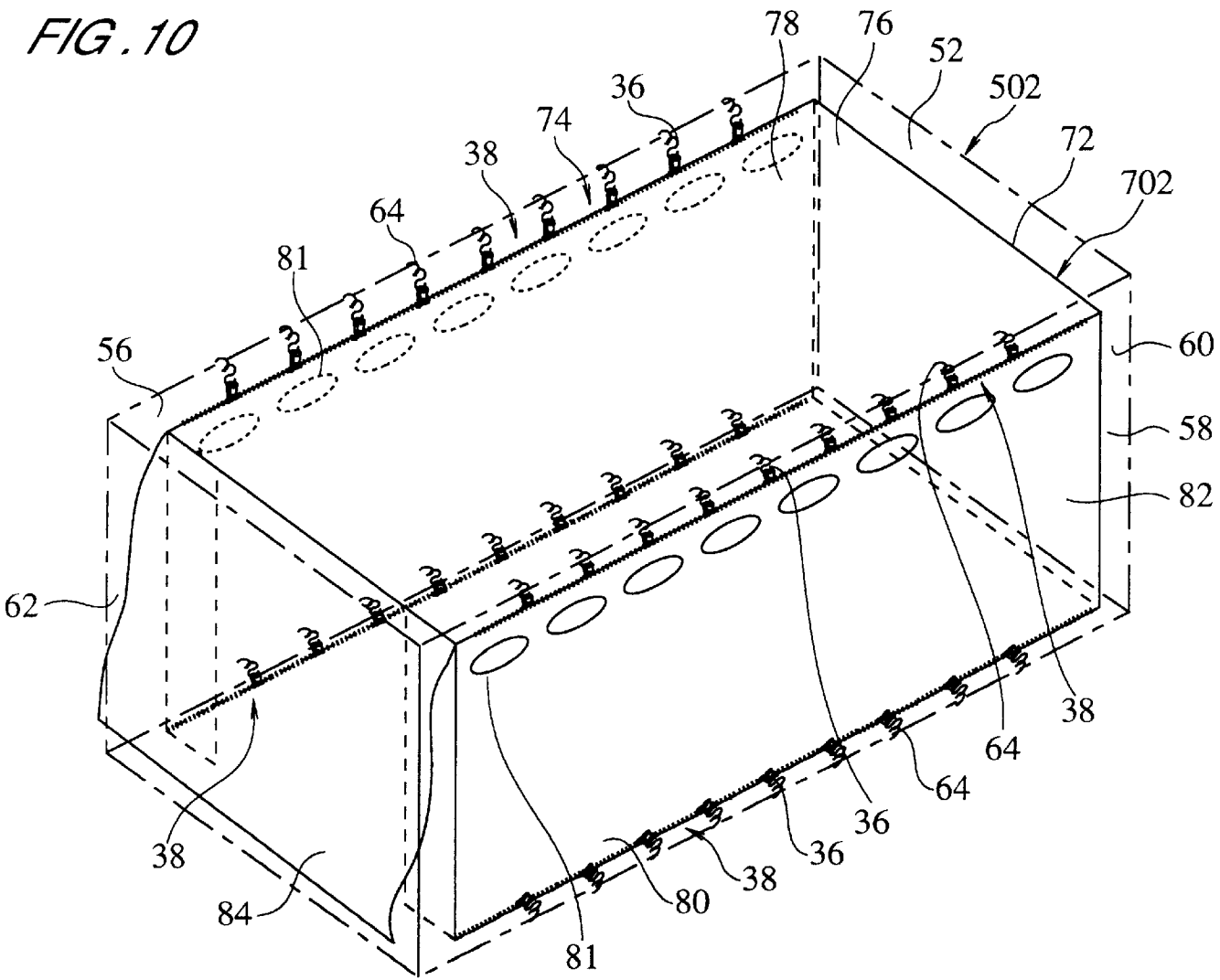
FIG. 10 is a perspective view showing yet a further modification of the water damage preventing curtain of FIG. 7 mounted within the container.

FIG. 10 is a perspective view showing the condition in which a water damage preventing curtain 702 constituting a further modification of the water damage preventing curtain 70 is mounted in container 502.

Water damage preventing curtain 702 differs from water damage preventing curtain 70 in that mounting devices 38 are provided in the bottom parts of left and right faces 78 and 80 also.

When a water damage preventing curtain 702 of this construction is mounted in a container 502 wherein container mounting members 64 are provided in the bottom part of left and right walls 56 and 58, the mounting members 36 of the mounting devices 38 provided in the bottom part of left and right faces 78, 80 are connected with the container mounting members 64 provided in the bottom part of left and right walls 56, 58 of container 502.

Mounting members 36 of mounting devices 38 provided in the bottom part of left and right faces 78, 80 can then be moved in positions matching the positions of container mounting members 64 provided in the bottom part of left and right walls 56, 58 of container 502.

(Third Embodiment)

Figure 11:
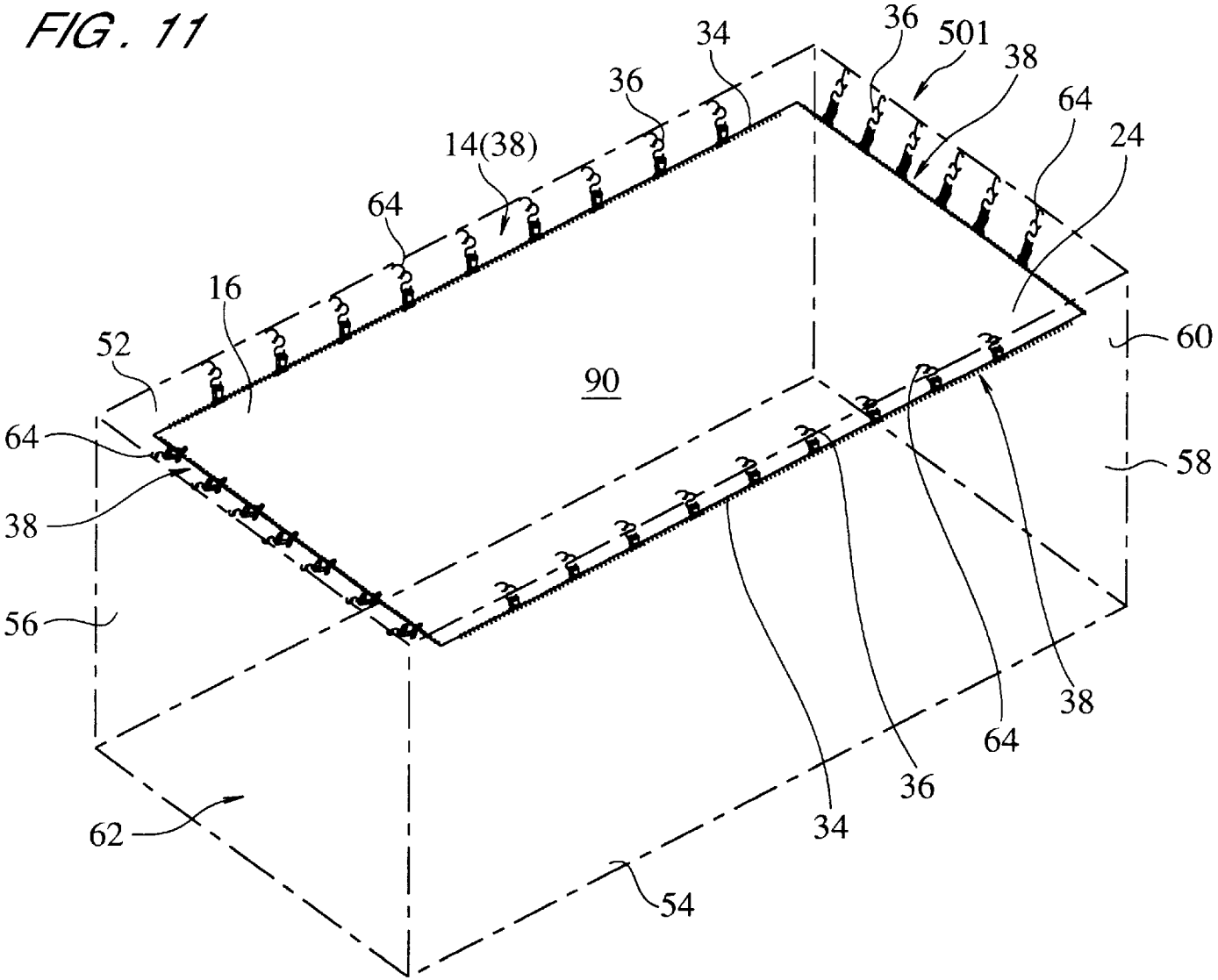
FIG. 11 is a perspective view showing a wetness preventing sheet for a container according to a third embodiment of the present invention mounted within the container.

FIG. 11 is a perspective view showing the condition in which a water damage preventing sheet 90 for a container according to a third embodiment of the present invention is mounted in a container 501.

As can be seen from FIG. 11, water damage preventing sheet 90 for a container according to this third embodiment of the present invention corresponds to the top face 16 of inner bag 10 of the first embodiment. Specifically, this water damage preventing sheet 90 is a waterproof sheet covering the top of the cargo accommodating space in container 501 and is constituted such as to prevent water damage of cargo accommodated in container 501 by water dripping from ceiling 52 in container 501 of moisture produced by condensation in the container.

This water damage preventing sheet 90 has a rectangular shape; mounting devices 38 having the same construction as mounting devices 38 mounted on inner bag 10 of the first embodiment are provided on all four sides thereof by the same method as in the case of the first embodiment.

Water damage preventing sheet 90 constructed in this way is mounted on a container 501 wherein container mounting members 64 are provided in the upper part of left and right walls 56, 58, rear wall 60 and front wall 62. Specifically, water damage preventing sheet 90 is mounted in the top part of the cargo accommodating space in container 501 by connecting mounting members 36 of mounting devices 38 provided on each side with container mounting members 64.

Mounting members 36 of mounting devices 38 can then be moved along sliding fasteners 34 in positions matching the positions of container mounting members 64 provided in the upper parts of the left and right walls 56, 58, rear wall 60 and front wall 62 of container 501.

Some or all of sliding fasteners 34 of mounting devices 38 provided on each side may be integrated, or they may be respectively independent.

Furthermore, although, in the present embodiment, mounting devices 38 were provided on each side of sheet 90, depending on the dimensions of the sheet, it would be possible to provide mounting devices 38 on three sides or on two opposite sides.

(Fourth Embodiment)

Figure 12:
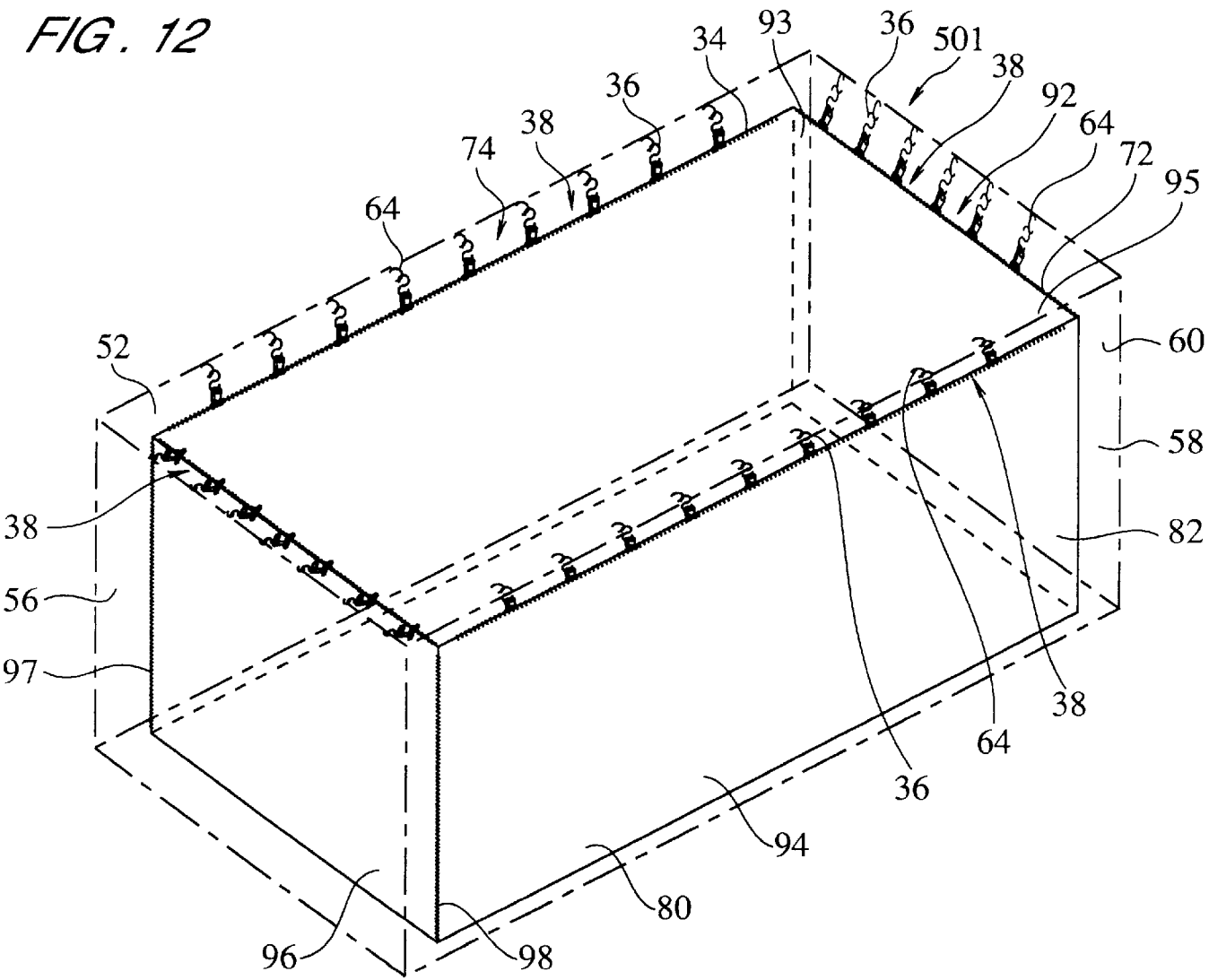
FIG. 12 is a perspective view showing a contamination preventing curtain according to a fourth embodiment of the present invention mounted within the container.

FIG. 12 is a perspective view showing a condition in which a contamination preventing curtain 92 for a container according to a fourth embodiment of the present invention is mounted in a container 501.

As can be seen from FIG. 12, contamination preventing curtain 92 for a container according to a fourth embodiment of the present invention consists in a curtain constituted of left and right faces 93, 94, rear face 95 and front face 96 respectively corresponding to the four faces, namely, left and right faces 20, 22, rear face 24 and front face 26 of inner bag 10 of the first embodiment. This contamination preventing curtain 92 is a sheet covering the periphery of the cargo accommodating space within container 501 and is constituted so as to prevent contamination caused by cargo accommodated in the cargo accommodating space coming into contact with the inside wall of the container. This contamination preventing curtain 92 has mounted thereon opening and closing sliding fasteners 97, 98 for opening and closing front face 96 on the junction line between left and right faces 93, 94 and front face 96.

In the case of contamination preventing curtain 92, mounting devices 38 having the same construction as mounting devices 38 provided on inner bag 10 of the first embodiment are provided on practically the entire upper edges of places 93, 94, 95 and 96, by the same method as in the case of the first embodiment.

Contamination preventing curtain 92 having such a construction is mounted on a container 501 provided with container mounting members 64 on the upper part of left and right walls 56 and 58, rear wall 60 and front wall 62. Specifically, mounting members 36 of mounting devices 38 provided at the upper edges of each face are mounted at the periphery of the cargo accommodating space in container 501 by connection with container mounting members 64.

Mounting members 36 of mounting devices 38 can then move along sliding fasteners 34 matching the position of container mounting members 64 provided in the upper part of the left and right walls 56, 58, rear wall 60 and front wall 62 of container 501.

Also, of the sliding fasteners 34 of mounting members 38 respectively provided on the upper edges of the faces, some or all can be integrated, or they may be respectively independent.

Furthermore, although, in the case of the contamination preventing curtain 92 of this embodiment, mounting devices 38 were provided solely on the upper edges of faces 93, 94, 95 and 96, in addition to this, it would be possible to provide mounting devices 38 also at the lower edges of some or all of faces 93, 94, 95, and 96. When a contamination preventing curtain of such a construction is mounted in the cargo accommodating space of a container provided with container mounting members 64, the mounting devices 38 at the bottom edges are connected with container mounting members 64 provided in the bottom part of the container wall. As a result, the contamination preventing curtain is connected with the container above and below, and is mounted in the cargo accommodating space in a condition with no sagging.

(Fifth Embodiment)

Figure 13:
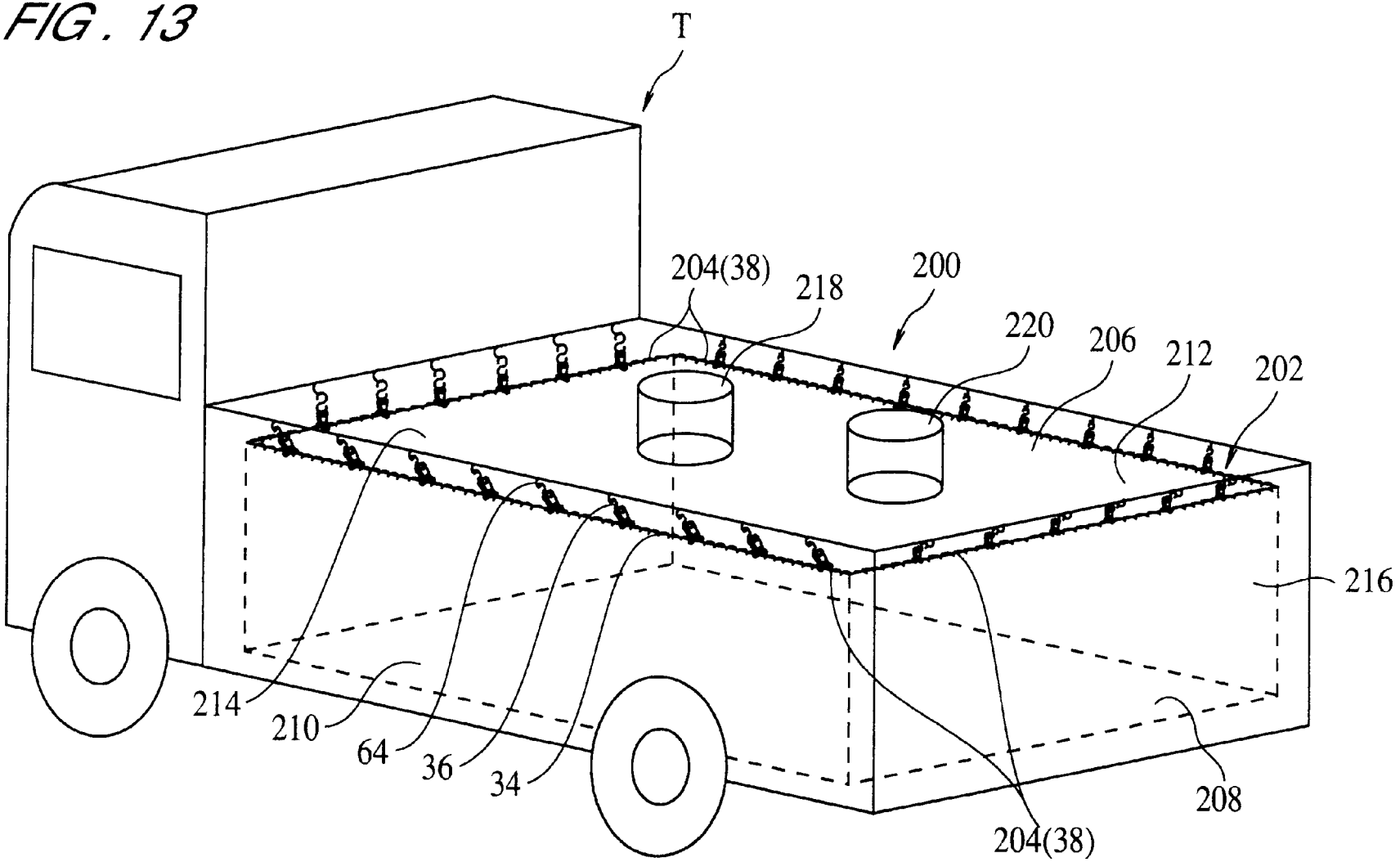
FIG. 13 is a perspective view showing a bag for a cargo bay according to a fifth embodiment of the present invention mounted on a cargo bay opening towards the top of a truck.

FIG. 13 is a perspective view showing a condition in which a cargo bay bag 200 according to a fifth embodiment of the present invention is mounted on a cargo bay that is open towards the front of a truck.

As can be seen from FIG. 13, cargo bay bag 200 of the fifth embodiment of the present invention is constituted so as to be mounted in the cargo accommodating space opening upwards of the cargo bay of the truck. Also, cargo bay bag 200 is constituted so that it can accommodate various contents such as synthetic resins of various types or powder raw material thereof or granular material such as pellets or powder material.

Just as in the case of inner bag 10 of the first embodiment, cargo bay bag 200 comprises a bag body 202 and a mounting device or a connecting device 204 that connects bag body 202 with the cargo bay of truck T. Cargo bay bag 200 is mounted in the cargo accommodating space in the cargo bay, with bag body 202 in an expanded condition, connected with the cargo bay of the truck through connecting device 204. Thus, cargo bay bag 200 essentially has the same construction as inner bag 10, but differs from inner bag 10 in various respects such as shape and material properties, on account of the different conditions of use.

When bag body 202 is mounted in the rectangular prismatic cargo bay, it has an approximately rectangular prismatic shape covering the cargo accommodating space in the cargo bay. Specifically, bag body 202 comprises a top face 206 that covers the top of the cargo accommodating space of the cargo bay, a bottom face 208 that covers the floor of the cargo bay, a left face 210 and a right face 212 that respectively cover the left wall and right wall of the cargo bay, a rear face 214 that covers the rear wall of the cargo bay, and a front face 216 that covers the front wall of the cargo bay. Bag body 202 is made for example of polyethylene but material properties may be suitably altered depending on the conditions of use, such as the type of contents to be accommodated.

An introduction unit 218 and a discharge unit 220 are provided in the top face 206 of bag body 202. Both introduction unit 218 and discharge unit 220 are tubular units communicating with the internal space of bag body 202 and are employed when contents are discharged from or introduced into bag body 202. Also, introduction unit 218 and discharge unit 220 are constructed such that they can be closed by means for closure, not shown, when not needed.

Connecting device 204 are provided along the junction lines between the faces of bag body 202, namely, top face 206, left face 210, right face 212, rear face 214 and front face 216. As can be seen from FIG. 13, mounting devices 38 having the same construction as mounting devices 38 provided in the first embodiment, provided with sliding fasteners 34 and mounting members 36, are provided on these connecting device 204 by the same method as in the case of the first embodiment.

When bag 200 of such a construction is mounted in the cargo bay of a truck in which there are provided cargo bay mounting members 64 at the upper part of the left and right walls and front and rear walls of the cargo bay, mounting members 36 of mounting devices 38 provided along the junction lines between the top face 206, left face 210, right face 212, rear face 214 and front face 216 of bag body 202 are connected with mounting members 64 provided in the cargo bay.

Mounting members 36 of mounting devices 38 provided on bag body 202 are then moved matching the positions of mounting members 64 provided on the cargo bay.

In addition, mounting devices 38 are provided along the junction lines between some or all of the faces of bag body 202, namely, bottom face 208, left face 210, right face 212, rear face 214 and front face 216.

In this embodiment, a cargo bay bag 200 was mounted in a cargo bay open towards the top of the truck, but it would be possible for a bag 200 constructed in this way to be mounted within the cargo accommodating space of a van.

The positions where the mounting devices are provided are not restricted to those in the examples of the above embodiments but could be suitably modified in accordance with the mode of use such as inner bag or water damage preventing curtain etc.

Also, in the embodiment described above, mounting members 36 comprised ring-shaped portions **36*a* and hook sections 36*b*. However, mounting members 36** can be of any configuration so long as they are capable of connection to the mounting members on the side of the mounting location such as the container mounting members. For example, they could be annular members such as D-rings or karabiners or C-rings etc.

Furthermore, in the above embodiments, mounting members 36 were connected with a pair of sliders 348, 348 arranged adjacently such that the track was in open condition therebetween. However, in the present invention, a mounting member 36 could be connected to a pair of sliders 348, 348 arranged adjacently such that the track therebetween is in open condition or could be connected to a single slider 348.

Figure 14:
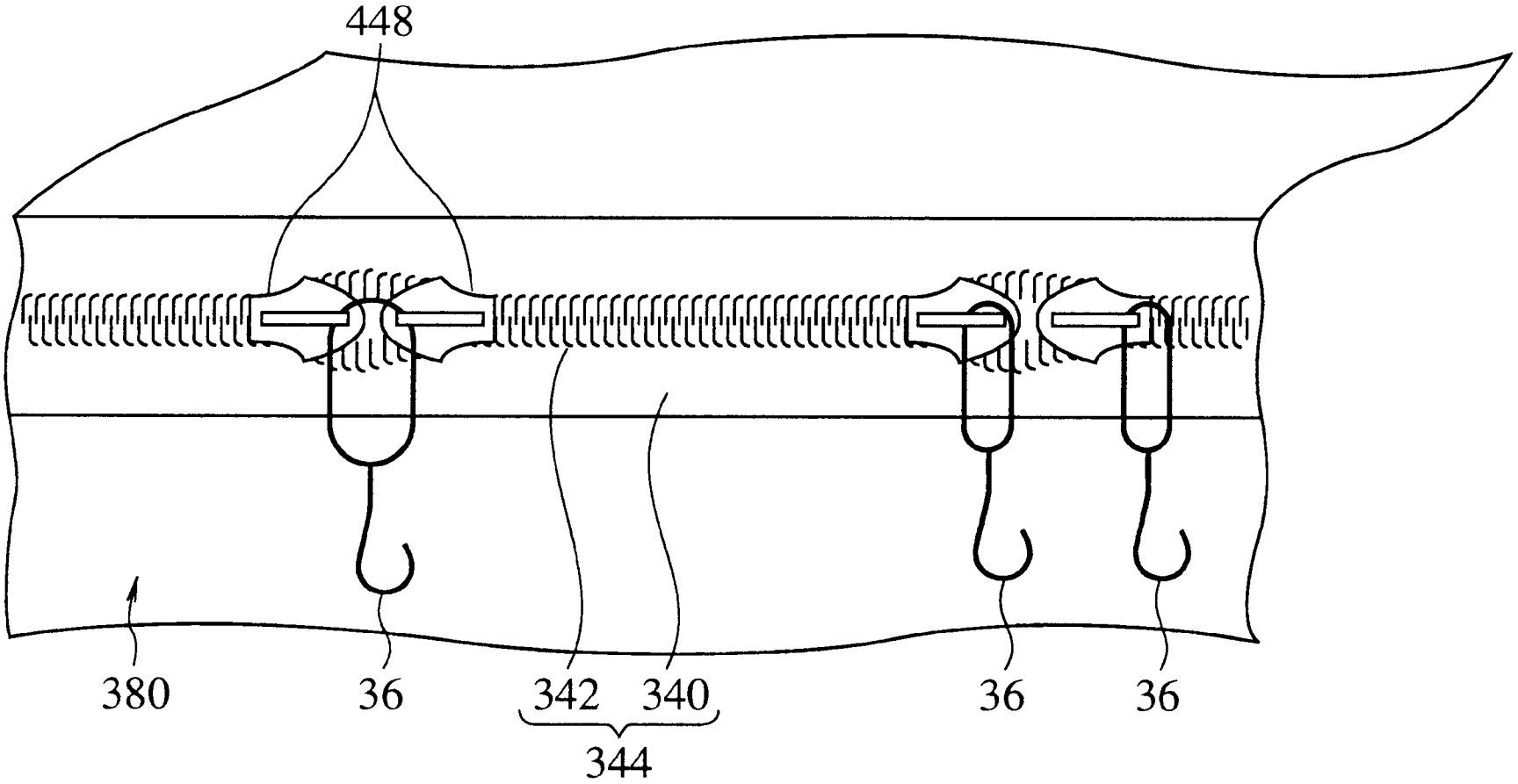
FIG. 14 is a view illustrating a mounting device according to a modification of the mounting device of FIG. 2.
Figure 15:
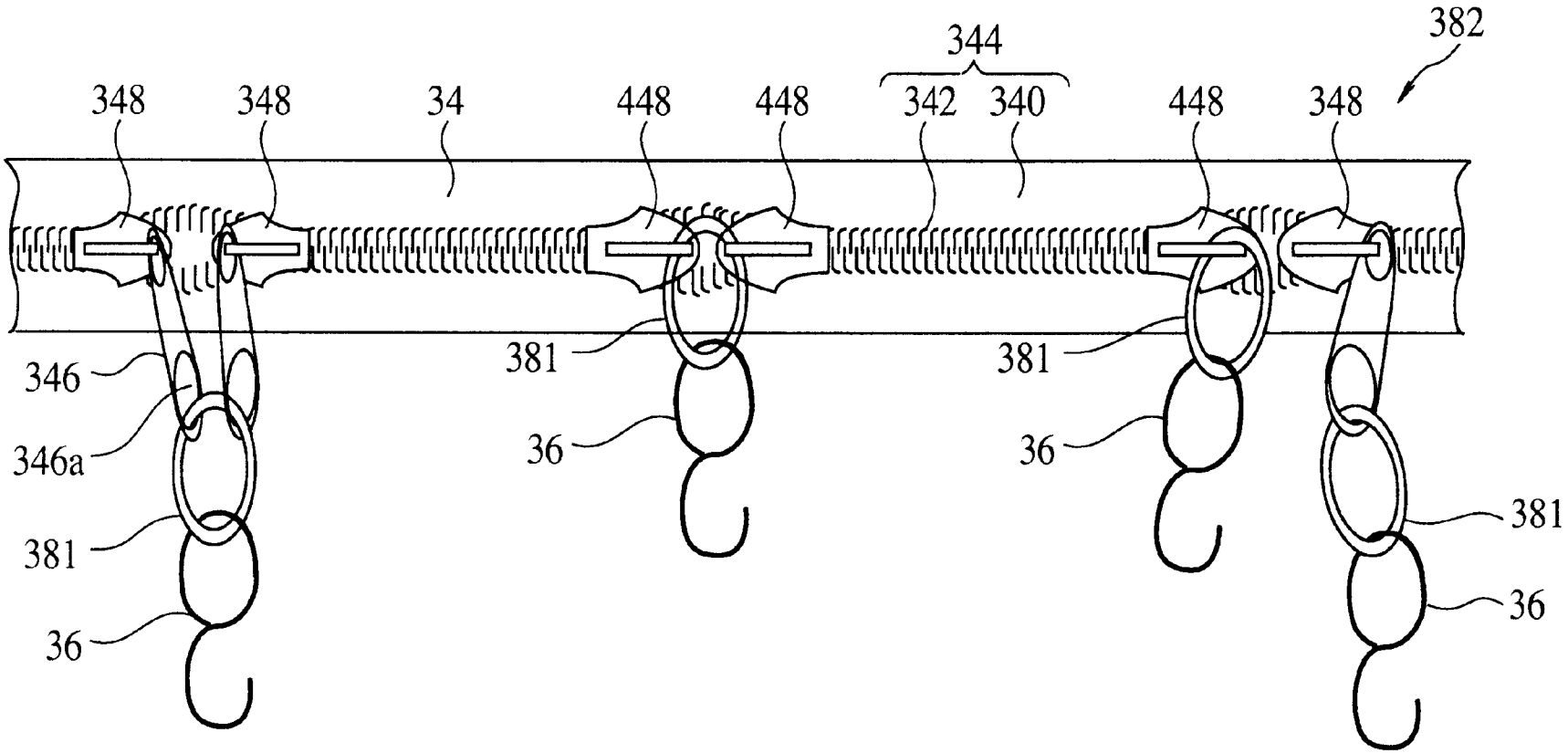
FIG. 15 is a view showing a mounting device according to a further modification of the mounting device of FIG. 2.
Figure 16:
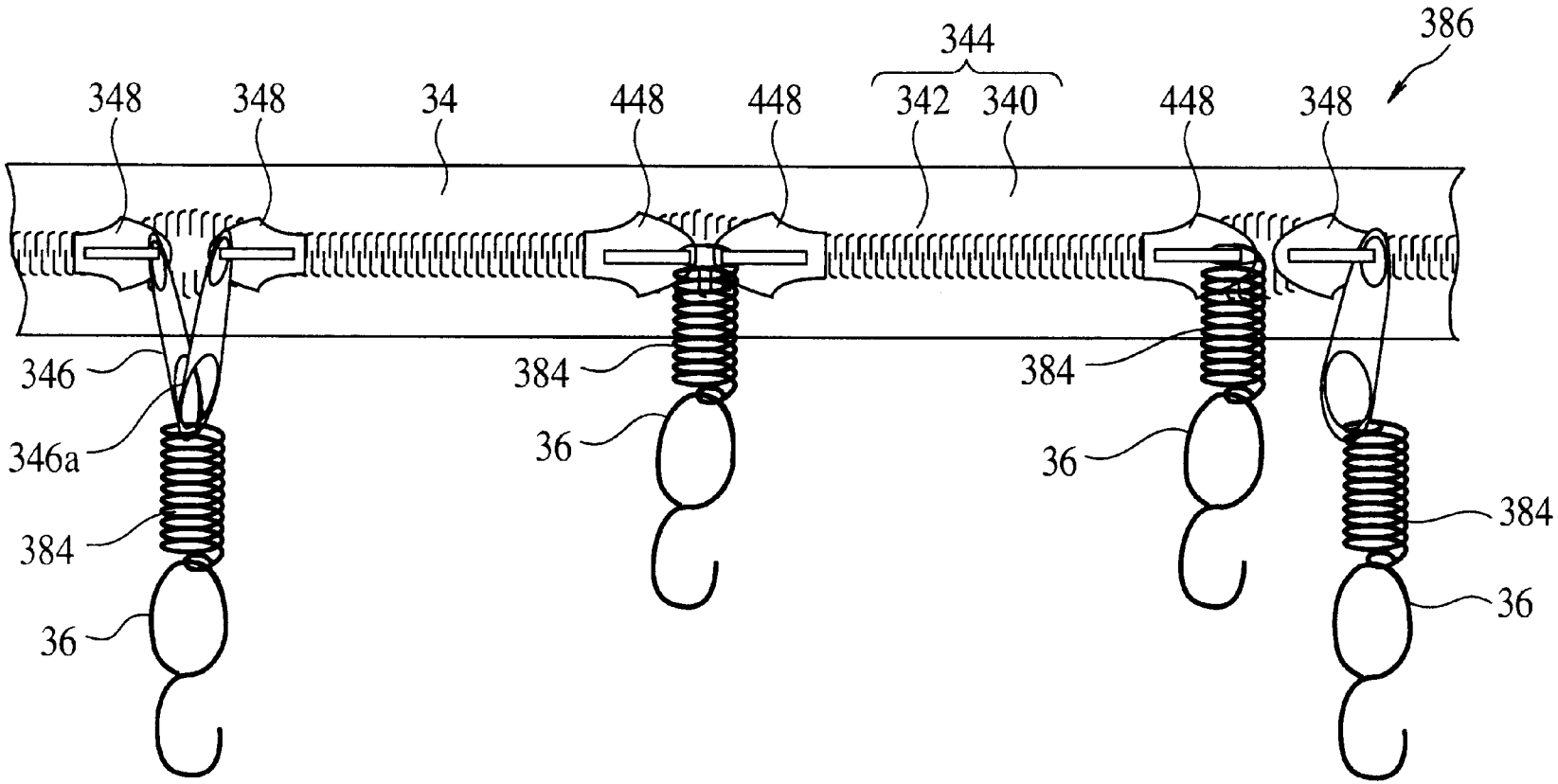
FIG. 16 is a view showing a mounting device according to yet a further modification of the mounting device of FIG. 2.

FIGS. 14 to 16 are views showing modified examples of mounting device 38.

In the case of the mounting devices 38 of the embodiments described above, mounting members 36 were connected with sliders 348 by insertion of mounting member 36 through aperture 346*a* of pull 346 of slider 348, but the connection between mounting members and sliders is not restricted to this mode. For example, as shown in FIG. 14, a mounting device 380 wherein a single mounting member 36 is directly connected to one or a pair of sliders 448 that are not provided with pulls, is also included in the present invention.

Also, for example, as shown in FIG. 15, a mounting device 382 could be constituted by interposing an annular rubber member 381 constituting a resilient member capable of extension or contraction between mounting member 36 and sliders 348, 448, or, alternatively, as shown in FIG. 16, a mounting device 386 could be constituted by interposition of a spring 384 constituting a resilient member capable of elongation or contraction between mounting member 36 and sliders 348, 448. Annular rubber element 381 or spring 384, in the case of sliders 348 that are provided with pulls 346, could be arranged between pull 346 and mounting member 36, or, in the case of sliders 448 that are not provided with pulls, could be provided between sliders 448 and mounting member 36. Also, a single annular rubber member 381 or spring 384 could be connected to a single slider 348 (448), or, alternatively, a single annular rubber member 381 or spring 384 could be connected to two sliders 348, 348 (448, 448) forming a pair.

With mounting devices 382, 386 having such a construction, when for example a mounting member 36 is connected to a mounting location mounting member 64 provided on a mounting location such as a container, annular rubber member 381 or spring 384 is extended by pulling mounting member 36, thereby enabling the distance between sliding fastener 34 and mounting member 36 to be increased. As a result, the operation of connecting mounting member 36 and for example mounting location mounting member 64 is facilitated. Furthermore, annular rubber member 381 or spring 384 which constitute resilient members capable of extension or retraction function as a buffer member between mounting member 36 and sliders 348, 448 when mounting member 36 is connected to for example mounting member 64 of the mounting location. For example, when mounting member 36 is pulled in a direction such as to separate sliders 348, 448, or when sliders 348, 448 are pulled in a direction so as to separate from mounting member 36, annular rubber member 381 or spring 384 is extended. As a result, the force applied to sliders 348 or 448 is buffered, making it less likely for sliders 348 or 448 to be damaged.

Figure 17:
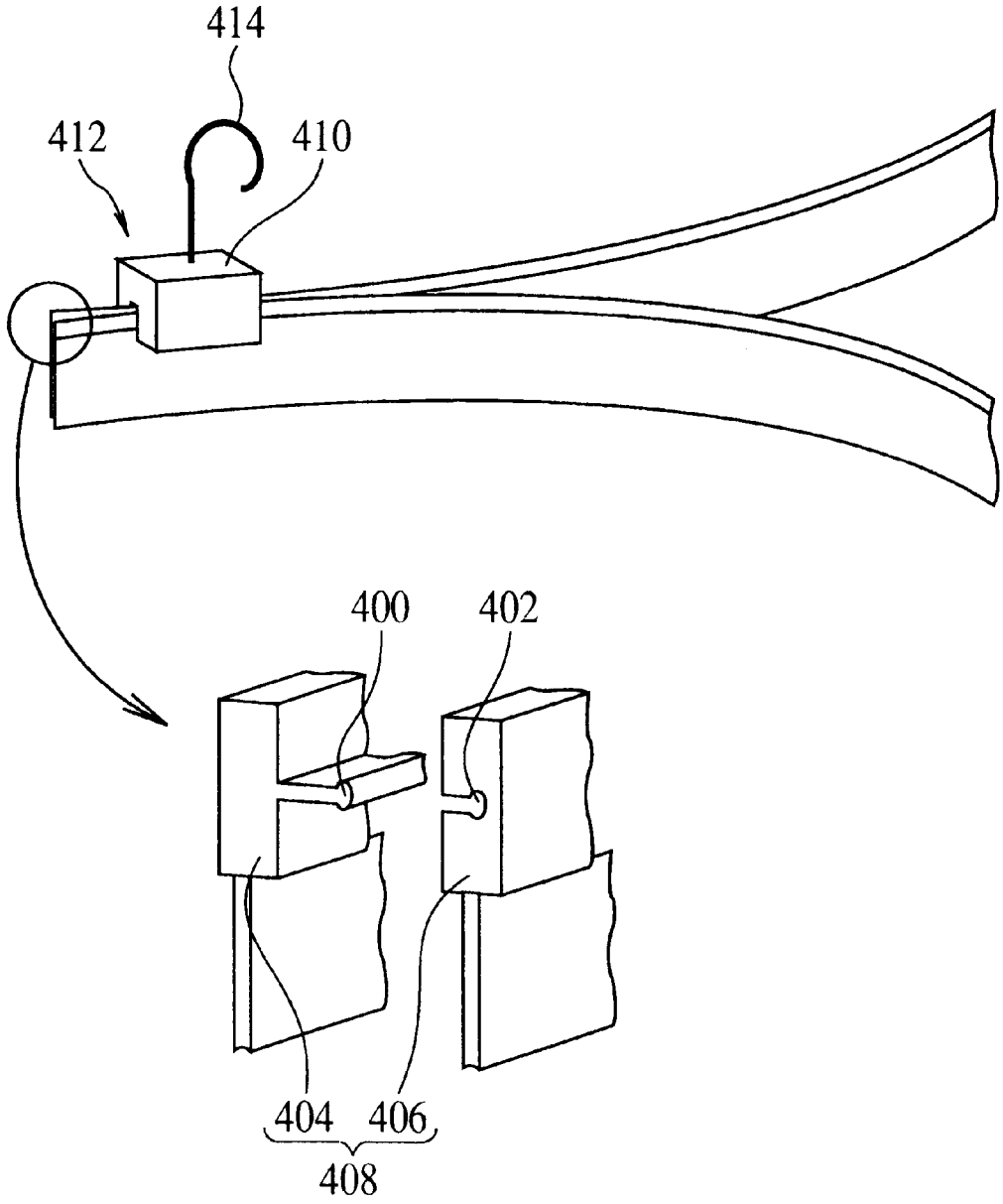
FIG. 17 is a perspective view showing another mode of fastener.

FIG. 17 is a view showing a further embodiment of a fastener.

In the above embodiments, the fastener was a sliding fastener, also called a zip fastener, zipper or zip. However, the fastener employed in a mounting device according to the present invention is not restricted to a sliding fastener and can be any type of fastener that comprises a slider and a flexible track that is opened or closed by sliding of this slider. For example, it could be a fastener 412 as shown in FIG. 17 comprising a track 408 provided with a pair of flexible rails 404, 406 respectively provided with a convex strip 400 and concave strip 402 on opposite faces, and a slider 410 that slides along this track 408, track 408 being opened and closed by engagement or disengagement of convex strip 400 and concave strip 402 of track 408 by sliding of this slider 410 along track 408. Mounting member 414 is connected to slider 410.

Also, although, in the embodiments described above, the mounting devices were provided on an inner bag or water damage preventing curtain or the like, it would also be possible to provide the mounting devices on a mounting location such as a wall or another type of mounting location, such as an air-tight bag or thermal insulation bag. In particular, when the mounting location is flexible, such as a structural article based on a curtain, this is beneficial, since the mounting device can also be deformed in accordance with the shape of this flexible mounting location.

Furthermore, although, in the above embodiments, ventilation portions were provided in the inner bag for a water damage preventing curtain, inner bags or water damage preventing curtains not provided with such ventilation ports are also included within the scope of the present invention.

As described above, according to the present invention, there are provided a mounting device whereby a mounted article can be mounted in a suitable condition by movement of the position of a mounting member, and an inner bag for a cargo accommodating space provided with such a mounting device and a water damage preventing curtain for a cargo accommodating space.

What is claimed is:

1. An inner bag for a cargo accommodating space, the bag comprising a bag body adapted to be mounted within said cargo accommodating space and connecting elements for mounting said bag body in said cargo accommodating space in expanded condition, the connection elements further comprising:

a mounting device including a fastener having at least one slider and a flexible track that is opened or closed by sliding said slider, and a mounting member capable of engagement with a mounting location mounting member provided in said cargo accommodating space and connected to said slider, wherein said fastener is a sliding fastener and wherein a resilient member that is capable of elongation and contraction is provided between said slider and said mounting member.

2. The inner bag for a cargo accommodating space according to claim 1, wherein said slider is provided with a pull, and said mounting member is connected to said pull.

3. The inner bag for a cargo accommodating space according to claim 2, wherein said sliding fastener comprises at least two sliders, said two sliders constitute a pair and are arranged adjacently on said flexible track, and one said mounting member is connected to both of said two adjacently arranged sliders, and wherein a plurality of pairs of said sliders are arranged on a flexible track, and one of said mounting members is connected respectively to each pair of sliders.

4. The inner bag for a cargo accommodating space according to claim 1, wherein said sliding fastener comprises at least two sliders, said two sliders constitute a pair and are arranged adjacently on said flexible track, and one said mounting member is connected to both of said two adjacently arranged sliders.

5. The inner bag for a cargo accommodating space according to claim 4, wherein a plurality of pairs of said sliders are arranged on a flexible track, and one of said mounting members is connected respectively to each pair of sliders.

6. The inner bag for a cargo accommodating space according to claim 4, wherein two sliders constituting said pair are arranged adjacently on said flexible track such that said flexible track is in an open condition between these two sliders.

7. The inner bag for a cargo accommodating space according to claim 6, wherein said bag body has a substantially rectangular prismatic shape comprising a top face covering a ceiling of said cargo accommodating space, a bottom face covering a floor of said cargo accommodating space, left and right side faces covering left and right sides of said cargo accommodating space, and a front face covering a front of said cargo accommodating space; and said mounting devices are respectively provided along a junction line between said top face and left face of said bag body and that between said top face and right face of said bag body.

8. The inner bag for a cargo accommodating space according to claim 6, wherein said mounting member comprises a hook that is engageable with a mounting location mounting member provided in the cargo accommodating space.

9. The inner bag for a cargo accommodating space according to claim 6, wherein said mounting member is an annular member that is capable of engaging with the mounting location mounting member provided in said cargo accommodating space.

10. The inner bag for a cargo accommodating space according to claim 1, wherein said bag body has a substantially rectangular prismatic shape comprising a top face covering a ceiling of said cargo accommodating space, a bottom face covering a floor of said cargo accommodating space, left and right side faces covering left and right sides of said cargo accommodating space, and a front face covering a front of said cargo accommodating space; and said mounting devices are respectively provided along a junction line between said top face and left face of said bag body and that between said top face and right face of said bag body.

11. The inner bag for a cargo accommodating space according to claim 1, wherein said mounting member comprises a hook that is engageable with a mounting location mounting member provided in the cargo accommodating space.

12. The inner bag for a cargo accommodating space according to claim 1, wherein said mounting member is an annular member that is capable of engaging with the mounting location member provided in said cargo accommodating space.

13. The inner bag for a cargo accommodating space according to claim 1, wherein a plurality of pairs of said sliders are arranged on a flexible track, and one of said mounting members is connected respectively to each pair or sliders, and wherein two sliders constituting said pair are arranged adjacently on said flexible track such that said flexible track is in an open condition between these two sliders.

14. An inner bag for a cargo accommodating space, the bag comprising a bag body adapted to be mounted within said cargo accommodating space and connecting elements for mounting said bag body in said cargo accommodating space in expanded condition, the connection elements further comprising:

a mounting device including a fastener having at least one slider and a flexible track that is opened or closed by sliding said slider, and a mounting member capable of engagement with a mounting location mounting member provided in said cargo accommodating space and connected to said slider;

wherein said fastener is a sliding fastener;

wherein said sliding fastener comprises at least two sliders, said two sliders constitute a pair and are arranged adjacently on said flexible track, and one said mounting member is connected to both of said two adjacently arranged sliders;

wherein two sliders constituting said pair are arranged adjacently on said flexible track such that said flexible track is in an open condition between these two sliders.

15. The inner bag for a cargo accommodating space according to claim 14, wherein said bag body has a substantially rectangular prismatic shape comprising a top face covering a ceiling of said cargo accommodating space, a bottom face covering a floor of said cargo accommodating space, left and right side faces covering left and right sides of said cargo accommodating space, and a front face covering a front of said cargo accommodating space; and said mounting devices are respectively provided along a junction line between said top face and left face of said bag body and that between said top face and right face of said bag body.

16. The inner bag for a cargo accommodating space according to claim 14, wherein said mounting member comprises a hook that is engageable with a mounting location mounting member provided in the cargo accommodating space.

17. The inner bag for a cargo accommodating space according to claim 14, wherein said mounting member is an annular member that is capable of engaging with the mounting location mounting member provided in said cargo accommodating space.

18. An inner bag for a cargo accommodating space, the bag comprising a bag body adapted to be mounted within said cargo accommodating space and connecting elements for mounting said bag body in said cargo accommodating space in expanded condition, the connection elements further comprising:

a mounting device including a fastener having at least one slider and a flexible track that is opened or closed by sliding said slider, and a mounting member capable of engagement with a mounting location mounting member provided in said cargo accommodating space and connected to said slider;

wherein said fastener is a sliding fastener;

wherein said slider is provided with a pull, and said mounting member is connected to said pull;

wherein said sliding fastener comprises at least two sliders, said two sliders constitute a pair and are arranged adjacently on said flexible track, and one said mounting member is connected to both of said two adjacently arranged sliders;

wherein two sliders constituting said pair are arranged adjacently on said flexible track such that said flexible track is in an open condition between these two sliders.

* * * * *